US012655614B2

(12) United States Patent
Nicholls et al.

(10) Patent No.: US 12,655,614 B2
(45) Date of Patent: Jun. 16, 2026

(54) MEASURE-UP PROCESSES THAT ENABLE POSITIONING A TIP OF A BUCKET OF AN EXCAVATOR

(71) Applicant: Caterpillar Trimble Control Technologies LLC, Dayton, OH (US)

(72) Inventors: Jeremy Nicholls, Christchurch (NZ); Peter G. France, Christchurch (NZ); Jeff Ducrot, Christchurch (NZ); Alistair Baker, Christchurch (NZ)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 1099 days.

(21) Appl. No.: 17/322,306

(22) Filed: May 17, 2021

(65) Prior Publication Data

US 2022/0364334 A1 Nov. 17, 2022

(51) Int. Cl.

| | |
|---|---|
| ***E02F 9/26*** | (2006.01) |
| ***E02F 3/36*** | (2006.01) |
| ***E02F 3/43*** | (2006.01) |
| ***E02F 9/00*** | (2006.01) |

(52) U.S. Cl.

CPC ..... *E02F 9/265* (2013.01); *E02F 3/3677* (2013.01)

(58) Field of Classification Search

CPC ..... E02F 9/265; E02F 3/3677; E02F 9/264; E02F 9/006; E02F 9/261; E02F 3/437; E02F 3/36; E02F 9/003; E02F 3/3686

USPC ..... 702/94

See application file for complete search history.

(56) References Cited

U.S. PATENT DOCUMENTS

| | | | | |
|---|---|---|---|---|
| 8,145,391 | B2 | 3/2012 | Omelchenko et al. | |
| 9,943,022 | B1 | 4/2018 | Alam | |
| 9,976,286 | B2 | 5/2018 | Seki et al. | |
| 2009/0069987 | A1* | 3/2009 | Omelchenko | E02F 9/2045 701/50 |
| 2012/0130602 | A1* | 5/2012 | Omelchenko | E02F 3/842 701/50 |
| 2017/0260717 | A1* | 9/2017 | Seki | E02F 3/32 |
| 2021/0262205 | A1* | 8/2021 | Boss | G01S 19/47 |

FOREIGN PATENT DOCUMENTS

| | | | | |
|---|---|---|---|---|
| CN | 106715800 A * | 5/2017 | | E02F 9/265 |
| EP | 3 872 270 A2 | 9/2021 | | |

OTHER PUBLICATIONS

English translation of CN-106715800, May 24, 2017. (Year: 2017).*
International Preliminary Report on Patentability for Application No. PCT/US2022/029177, mailed Nov. 30, 2023, 8 pages.
International Search Report and Written Opinion for Application No. PCT/US2022/029177, mailed Oct. 26, 2022, 12 pages.

* cited by examiner

*Primary Examiner* — Michael P Nghiem
(74) *Attorney, Agent, or Firm* — Kilpatrick Townsend & Stockton LLP

(57) ABSTRACT

Measure-up processes described herein provide data that enable three-dimensional (3D) positioning of a tip of a bucket of an excavator. The processes may include steps of curling a bucket of the excavator in and out, moving a stick of the excavator in and out, and moving the bucket so that it touches a point at different bucket angles. During each of the steps, data is generated using a tilt compensating survey pole and one or more inertial measurement units (IMUs).

6 Claims, 13 Drawing Sheets

MEASURE-UP PROCESSES THAT ENABLE POSITIONING A TIP OF A BUCKET OF AN EXCAVATOR

FIELD

Embodiments described herein relate generally to measure-up (or calibration) processes that enable three-dimensional (3D) positioning of a tip of a bucket of an excavator. The measure-up processes provide or generate data that can be used to enable the 3D positioning. Embodiments include methods for performing the measure-up processes, non-transitory computer-readable mediums storing instructions for performing the processes, implement guidance systems configured to perform the processes, and excavators that utilize the implement guidance systems.

BACKGROUND

It is often useful to track a 3D position of a tip of a bucket of an excavator. Some control systems can use the 3D position of the tip to automatically control movement of the bucket to achieve a planned design. An example of a planned design may be a particular ground contour at a job site. Other control systems can use the 3D position of the tip to indicate to an operator how close the tip is to the planned design. This allows the operator to manually control the bucket according to the design. While each of these conventional control systems can improve productivity and reduce operating costs, they can be expensive and complicated to implement. For mini excavators that are often used on smaller projects, the cost of these conventional control systems can be prohibitive, and the precision provided may be more than is required for the particular job.

In light of the above, control systems that are cheaper and easier to implement are desired. Particularly for mini excavators that are used on smaller projects where precise bucket control may not be necessary.

SUMMARY

Embodiments described herein provide improved measure-up processes that enable 3D positioning of a tip of a bucket of an excavator. The measure-up processes may use a tilt compensating survey pole (e.g., a global navigation satellite system (GNSS) survey pole) and one or more inertial measurement units (IMUs) to generate data that can be used to enable the 3D positioning. In accordance with a particular embodiment, for example, a method for performing a measure-up process on an excavator includes determining: (i) a relationship between an angle of a dog bone and an angle of a bucket relative to a stick of the excavator, (ii) an axis of rotation of a pivot point between the stick and the bucket in a frame of a first IMU integrated with a GNSS survey pole that is coupled to the bucket, and (iii) an axis of rotation of the dog bone in a frame of a second IMU coupled to the dog bone. The relationship between the angle of the dog bone and the angle of the bucket, the axis of rotation of the pivot point, and the axis of rotation of the dog bone are determined by curling the bucket of the excavator between a fully out position and a fully in position multiple times, with the GNSS survey pole coupled to the bucket and the second IMU coupled to the dog bone, and while curling the bucket, obtaining IMU measurements associated with the bucket using the first IMU and obtaining IMU measurements associated with the dog bone using the second IMU. The method also includes determining a position of a point on the ground using the GNSS survey pole, and coupling the GNSS survey pole to the stick of the excavator. The method also includes determining: (i) an axis of rotation of a pivot point between a boom of the excavator and the stick in a frame of the first IMU integrated with the GNSS survey pole, and (ii) an axis of rotation of the pivot point between the boom and the stick in a frame of the second IMU coupled to the dog bone. The axis of rotation of the pivot point between the boom and the stick in the frame of the first IMU and in the frame of the second IMU are determined by moving the stick of the excavator in toward a cab of the excavator and out away from the cab of the excavator multiple times, with the GNSS survey pole coupled to the stick and the second IMU coupled to the dog bone, and while moving the stick, obtaining IMU measurements associated with the stick using the first IMU and obtaining IMU measurements associated with the dog bone using the second IMU. The method also includes determining: (i) a pitch of the dog bone relative to the stick with the bucket fully curled in, and (ii) a pitch of the dog bone relative to the stick with the bucket fully curled out. The pitch of the dog bone relative to the stick with the bucket fully curled in and the pitch of the dog bone relative to the stick with the bucket fully curled out are determined by curling the bucket of the excavator between the fully out position and the fully in position multiple times, with the GNSS survey pole coupled to the stick and the second IMU coupled to the dog bone, and while curling the bucket, obtaining IMU measurements associated with the stick using the first IMU and obtaining IMU measurements associated with the dog bone using the second IMU. The method also includes determining: (i) a position of a pivot point between the stick and the bucket relative to a phase center of a GNSS receiver of the GNSS survey pole, and (ii) a position of the tip of the bucket relative to the pivot point between the stick and the bucket. The position of the pivot point relative to the phase center of the GNSS receiver, and the position of the tip of the bucket relative to the pivot point, are determined by moving the bucket so that the tip of the bucket touches the point on the ground at multiple different bucket angles, with the GNSS survey pole coupled to the stick and the second IMU coupled to the dog bone, and while touching the point on the ground at the multiple different bucket angles: measuring first positions using the GNSS receiver; obtaining IMU measurements associated with the stick using the first IMU, and obtaining IMU measurements associated with the dog bone using the second IMU. The method also includes determining a distance between the tip of the bucket and the pivot point between the stick and the bucket, determining a lateral distance between a centerline of the stick and the phase center of the GNSS receiver, and determining a width of the tip of the bucket. The data that enables the 3D positioning of the tip of the bucket is generated using at least some of: the relationship between the angle of the dog bone and the angle of the bucket, the axis of rotation of the pivot point between the stick and the bucket in a frame of the first IMU coupled to the bucket, the axis of rotation of the dog bone in a frame of the second IMU, the position of the point on the ground, the axis of rotation of the pivot point between the boom and the stick in a frame of the first IMU integrated with the GNSS survey pole, the pitch of the dog bone relative to the stick with the bucket fully curled in and the pitch of the dog bone relative to the stick with the bucket fully curled out, the position of the pivot point between the stick and the bucket relative to the phase center of the GNSS receiver, the position of the tip of the bucket relative to the pivot point between the stick and the bucket, the distance between the tip of the bucket and the pivot point between the stick and the bucket, the lateral distance between the centerline of the stick and the phase center of the GNSS receiver, and a width of the tip of the bucket.

In an embodiment, the bucket may be configured for tilt and curling motion, and the method also includes determining a roll offset between the bucket and a third IMU coupled to the bucket, and determining: (i) an axis of rotation of a hinge point in a frame of the third IMU coupled to the bucket, the hinge point enabling the tilt of the bucket, and (ii) the tilt of the bucket when tilted fully right and when tilted fully left. The axis of rotation of the hinge point and the tilt of the bucket when tilted fully right and when tilted fully left are determined by tilting the bucket between end stops with the GNSS survey pole coupled to the stick and the third IMU coupled to the bucket, and while tilting the bucket between the end stops, obtaining IMU measurements associated with the stick using the first IMU and obtaining IMU measurements associated with the bucket using the third IMU. The method also includes determining: (i) a position of the hinge point relative to the pivot point between the stick and the bucket, and (ii) a position of the tip of the bucket relative to the hinge point. The position of the hinge point relative to the pivot point and the position of the tip of the bucket relative to the hinge point are determined by tilting the bucket so that an end tip of the bucket touches the point on the ground at multiple different tilt angles, with the GNSS survey pole coupled to the stick and a third IMU coupled to the bucket, and while touching the point on the ground at the multiple different tilt angles: measuring second positions using the GNSS receiver, obtaining IMU measurements associated with the stick using the first IMU, and obtaining IMU measurements associated with the tilt of the bucket using the third IMU. Generating the data that enables the 3D positioning of the tip of the bucket may also include using at least some of: the roll offset between the bucket and the third IMU, the axis of rotation of the hinge point in the frame of the third IMU, the tilt of the bucket when tilted fully right and when tilted fully left, the position of the hinge point relative to the pivot point between the stick and the bucket, and the position of the tip of the bucket relative to the hinge point.

In accordance with another embodiment, a method for performing a measure-up process on an excavator includes curling the bucket of the excavator a first time between a fully out position and a fully in position multiple times, with a tilt compensating survey pole coupled to the bucket and an IMU coupled to a dog bone. The method also includes moving the stick of the excavator in toward a cab of the excavator and out away from the cab of the excavator multiple times, with the tilt compensating survey pole coupled to the stick and the IMU coupled to the dog bone. The method also includes curling the bucket of the excavator a second time between the fully out position and the fully in position multiple times, with the tilt compensating survey pole coupled to the stick and the IMU coupled to the dog bone. The method also includes moving the bucket so that the tip of the bucket touches a point at multiple different bucket angles, with the tilt compensating survey pole coupled to the stick and the IMU coupled to the dog bone. Data that enables 3D positioning of the tip of the bucket may be generated using position measurements obtained using the tilt compensating survey pole, orientation and angular rate measurements obtained using the tilt compensating survey pole, and IMU measurements obtained using the IMU. The position measurements are obtained while performing the step of moving the bucket. The orientation and angular rate measurements and the IMU measurements are obtained while performing the steps of curling the bucket the first time, moving the stick of the excavator, curling the bucket the second time, and moving the bucket.

In an embodiment where the bucket is configured for tilt and curling motion, the method also includes tilting the bucket between end stops with a second IMU coupled to the bucket, and tilting the bucket so that an end tip of the bucket touches the point at multiple different tilt angles, with the tilt compensating survey pole coupled to the stick and the second IMU coupled to the bucket. The data that enables the 3D positioning of the tip of the bucket may also be generated using second IMU measurements obtained using the second IMU and second position measurements obtained using the tilt compensating survey pole.

In another embodiment, the stick of the excavator is static while curling the bucket the first time.

In another embodiment, the tilt compensating survey pole includes sensors for performing the orientation and angular rate measurements and a GNSS receiver for performing the position measurements.

In another embodiment, the method also includes determining a position of the point using the tilt compensating survey pole.

In another embodiment, the data that enables the 3D positioning of the tip of the bucket is also generated using a distance from the tip of the bucket to a pivot point between the stick and the bucket, a lateral distance between a centerline of the stick and a phase center of a GNSS antenna of the tilt compensating survey pole, and a width of the tip of the bucket.

In another embodiment, an implement guidance system is configured to perform the 3D positioning of the tip of the bucket using the data provided by the measure-up process.

In yet another embodiment, an excavator having an implement guidance system is configured to perform the 3D positioning of the tip of the bucket using the data provided by the measure-up process.

In accordance with another embodiment, a non-transitory computer-readable medium stores instructions that, when executed by a processor, enable an implement guidance system to generate data that enables 3D positioning of a tip of a bucket of an excavator. The data is generated from steps including: curling the bucket of the excavator a first time between a fully out position and a fully in position multiple times, with a tilt compensating survey pole coupled to the bucket and an IMU coupled to the dog bone; moving the stick of the excavator in toward a cab of the excavator and out away from the cab of the excavator multiple times, with the tilt compensating survey pole coupled to the stick and the IMU coupled to the dog bone; curling the bucket of the excavator a second time between the fully out position and the fully in position multiple times, with the tilt compensating survey pole coupled to the stick and the IMU coupled to the dog bone; moving the bucket so that the tip of the bucket touches a point at multiple different bucket angles, with the tilt compensating survey pole coupled to the stick and the IMU coupled to the dog bone; and generating the data that enables the 3D positioning of the tip of the bucket, the data generated using position measurements obtained using the tilt compensating survey pole, orientation and angular rate measurements obtained using the tilt compensating survey pole, and IMU measurements obtained using the IMU. The position measurements are obtained while performing the step of moving the bucket, and the orientation and angular rate measurements and the IMU measurements are obtained while performing the steps of curling the bucket the first time, moving the stick of the excavator, curling the bucket the second time, and moving the bucket.

In an embodiment, the data is also generated from a step that includes tilting the bucket so that an end tip of the bucket touches the point at multiple different tilt angles, with the tilt compensating survey pole coupled to the stick and a second IMU coupled to the bucket, the second IMU for determining tilt of the bucket. The data that enables the 3D positioning of the tip of the bucket is also generated using second IMU measurements obtained using the second IMU and second position measurements obtained using the tilt compensating survey pole.

In accordance with yet another embodiment, an excavator includes a stick, a bucket coupled to the stick at a pivot between the stick and the bucket, and an implement guidance system configured to perform 3D positioning of a tip of the bucket. The implement guidance system is configured to use sensor data to perform a measure-up process for generating data that enables the 3D positioning of the tip of the bucket. The sensor data is obtained while: curling the bucket a first time between a fully out position and a fully in position multiple times, with a tilt compensating survey pole coupled to the bucket and an IMU coupled to a dog bone; moving the stick in toward a cab of the excavator and out away from the cab of the excavator multiple times, with the tilt compensating survey pole coupled to the stick and the IMU coupled to the dog bone; curling the bucket a second time between the fully out position and the fully in position multiple times, with the tilt compensating survey pole coupled to the stick and the IMU coupled to the dog bone; and moving the bucket so that the tip of the bucket touches a point at multiple different bucket angles, with the tilt compensating survey pole coupled to the stick and the IMU coupled to the dog bone. The sensor data includes position measurements obtained using the tilt compensating survey pole, orientation and angular rate measurements obtained using the tilt compensating survey pole, and IMU measurements obtained using the IMU.

In an embodiment, the position measurements are obtained while performing the step of moving the bucket, and the orientation and angular rate measurements and the IMU measurements are obtained while performing the steps of curling the bucket the first time, moving the stick, curling the bucket the second time, and moving the bucket.

In another embodiment, the sensor data is also obtained while tilting the bucket so that an end tip of the bucket touches the point at multiple different tilt angles, with the tilt compensating survey pole coupled to the stick and a second IMU coupled to the bucket. The second IMU is for determining tilt of the bucket. The sensor data also includes second IMU measurements obtained using the second IMU and second position measurements obtained using the tilt compensating survey pole.

In yet another embodiment, the implement guidance system includes one or more processors configured to use the data to position the tip of the bucket.

Numerous benefits are achieved using embodiments described herein over conventional systems and techniques. For example, some embodiments provide simple measure-up processes that can be performed relatively quickly and easily. In some cases, the measure-up processes are simple enough that an operator in the field can perform them. In addition, some embodiments provide measure-up processes that can be performed using fewer sensors than conventional techniques. Using fewer sensors can reduce costs and simplify implementation. The sensors may also be cheaper and less complex. For example, some conventional techniques may require a total station and multiple IMUS, while some embodiments described herein may simply use a tilt compensating survey pole and a single IMU. Further, when not used for the measure-up processes, the tilt compensating survey pole may be used for conventional position measurements. These and other benefits are described throughout the specification with reference to the appended drawings.

DETAILED DESCRIPTION

Embodiments described herein provide measure-up processes that can be used to provide data that enables 3D positioning of a tip of a bucket of an excavator. The data is generated primarily using measurements or outputs from a conventional tilt compensating survey pole and one or more IMUs. The tilt compensating survey pole is coupled to the bucket of the excavator during some steps of the measure-up processes and coupled to a stick of the excavator during other steps of the measure-up processes. An IMU is coupled to a dog bone during some steps of the measure-up processes. The dog bone is part of the linkage between the bucket and the stick that can be used as a proxy for bucket orientation. Other IMUs may be used in some embodiments as described more fully below.

Figure 1:
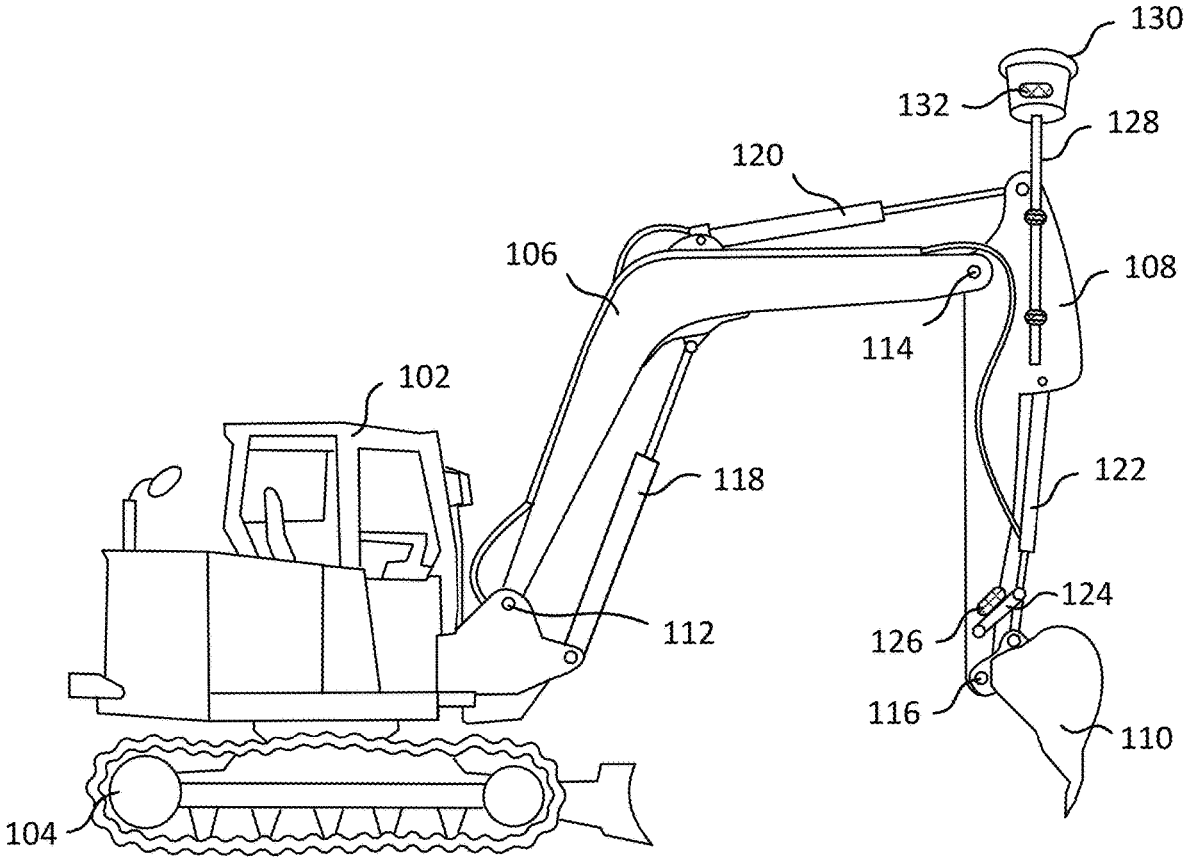
FIG. 1 is a simplified side view of an exemplary excavator that may be used with some of the embodiments described herein.

FIG. 1 is a simplified side view of an exemplary excavator that may be used with some of the embodiments described herein. The excavator includes a cab 102 (or platform) and an undercarriage 104. The cab 102 is configured to rotate around a vertical axis using a hydraulic motor or by other means. The undercarriage 104 is configured to support the cab 102 and, in this example, the undercarriage 104 includes tracks that provide translational movement of the excavator. The cab 102 may be coupled to the undercarriage 104 at a point of rotation between the cab 102 and the undercarriage 104.

The excavator in this example also includes a boom 106, a stick 108, and a bucket 110. The boom 106 is pivotally coupled to the cab 102 at a pivot point 112, the stick 108 is pivotally coupled to the boom 106 at a pivot point 114, and the bucket 110 is pivotally coupled to the stick 108 at a pivot point 116. Hydraulic devices 118, 120, 122 are provided to move the boom 106, the stick 108, and the bucket 110. It should be appreciated that the excavator can be used with other implements or tools besides the bucket 110, such as augers, trenchers, compactors, and the like.

Excavators commonly utilize a variety of sensors to monitor positions of various machine elements and/or to provide a display of element positions to an operator. The excavator in FIG. 1 includes a global navigation survey system (GNSS) survey pole 128 coupled to the stick 108 and an IMU 126 coupled to the dog bone 124. The GNSS survey pole 128 is a tilt compensating survey pole that can be used for position measurements and orientation and angular rate measurements.

The GNSS survey pole 128 in this example includes a conventional GNSS antenna 130. A GNSS receiver may be integrated within a housing of the GNSS antenna 130, and one or more other sensors, such as an IMU 132, may also be integrated within the housing and used for the orientation and angular rate measurements. The GNSS survey pole 128 may be removably coupled to the stick 108 using mounts that provide a rigid coupling.

GNSS survey poles are commonly used for survey applications and, while configurations of tilt compensating survey poles may vary, they typically allow measurement of position as well as orientation (pitch, roll, and yaw) and angular rate. Merely by way of example, some tilt compensating survey poles include a GNSS receiver for measuring position, accelerometers for measuring tilt angle (pitch and roll), a magnetometer for measuring yaw, and one or more gyroscopes for measuring angular rate. Other tilt compensating survey poles may use a calibration procedure along with sensors, such as gyroscopes to track rotation and determine yaw. The accelerometers and/or gyroscopes may be provided by an IMU integrated with the tilt compensating survey pole. Embodiments described herein are not limited to a particular configuration, however, and are applicable to any 3D position, 3D orientation, and 3D angular rate measuring survey pole.

As mentioned previously, the dog bone 124 is part of the linkage between the bucket 110 and the stick 108. The IMU 126 is coupled to the dog bone 124 to keep it away from the debris commonly associated with the area immediately around the bucket 110. A relationship between an angle of the dog bone 124 and an angle of the bucket 110 allows the IMU 126 to be mounted away from the bucket 110 while still providing measurements that can be used to position or track a tip of the bucket 110.

The IMU 126 may be a conventional IMU with accelerometers for determining a tilt angle of the dog bone 124 relative to a gravity vector. The IMU 126 may also include gyroscopes to track 3D rate of rotation of the dog bone. The IMU is not limited to a particular configuration and may include any device or sensor configured to determine tilt and/or tilt rate.

It should be appreciated that the excavator shown in FIG. 1 is used merely as an example, and other excavators having different configurations may be used with the embodiments described herein. Also, while the embodiments described herein may be particularly beneficial when used with mini excavators that may not otherwise include implement guidance features, the embodiments are not limited to mini excavators and may be implemented on larger and more complex systems.

Figure 2:
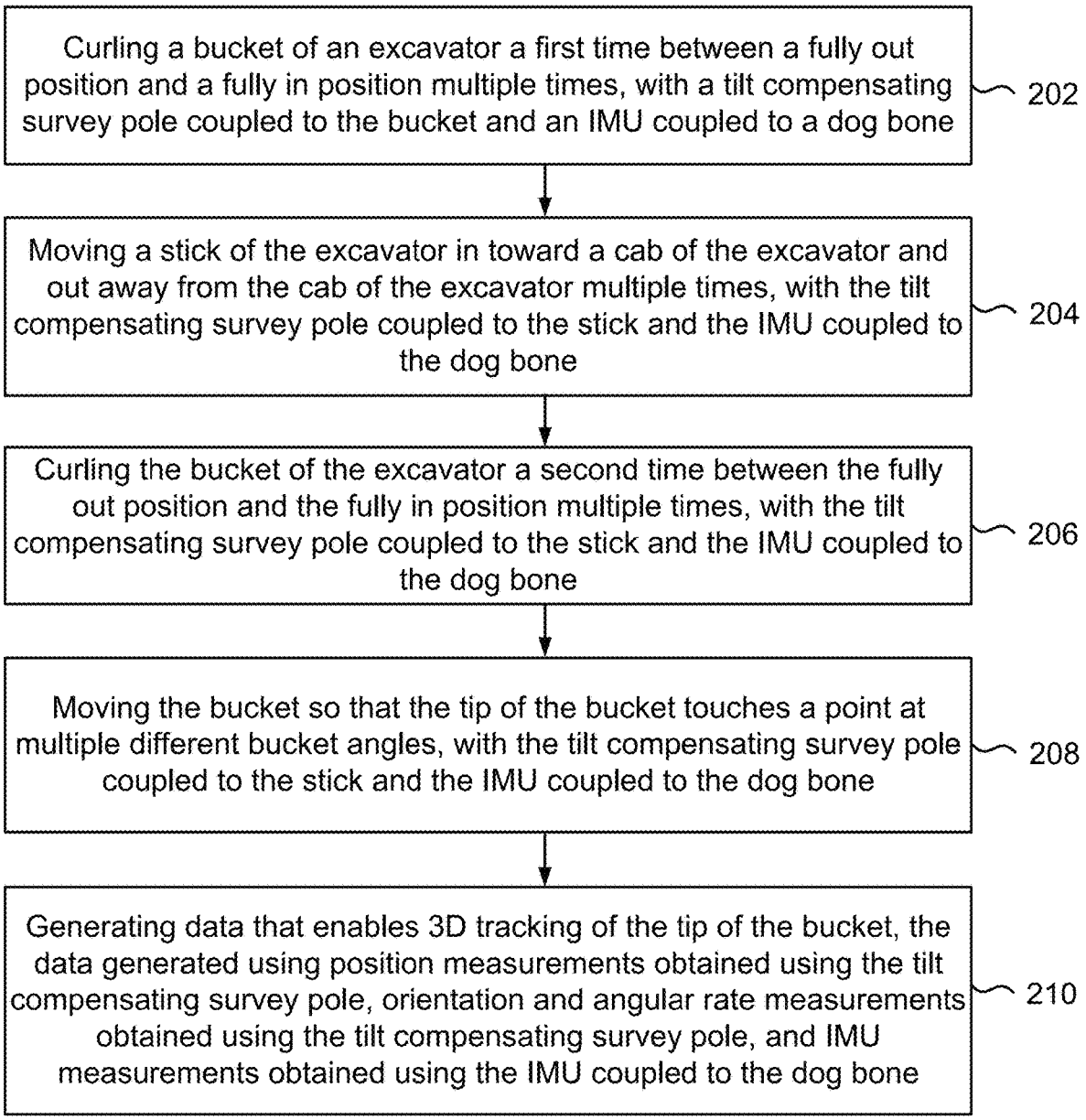
FIGS. 2-4 are flowcharts illustrating exemplary measure-up processes used to provide data that enables 3D positioning of a tip of a bucket of an excavator in accordance with some embodiments.

FIG. 2 is a flowchart illustrating an exemplary measure-up process used to provide data that enables 3D positioning of a tip of a bucket of an excavator in accordance with some embodiments. The measure-up process includes a step of curling the bucket of the excavator between a fully out position and a fully in position multiple times, with a tilt compensating survey pole coupled to the bucket and an IMU coupled to a dog bone (202).

Figure 5:
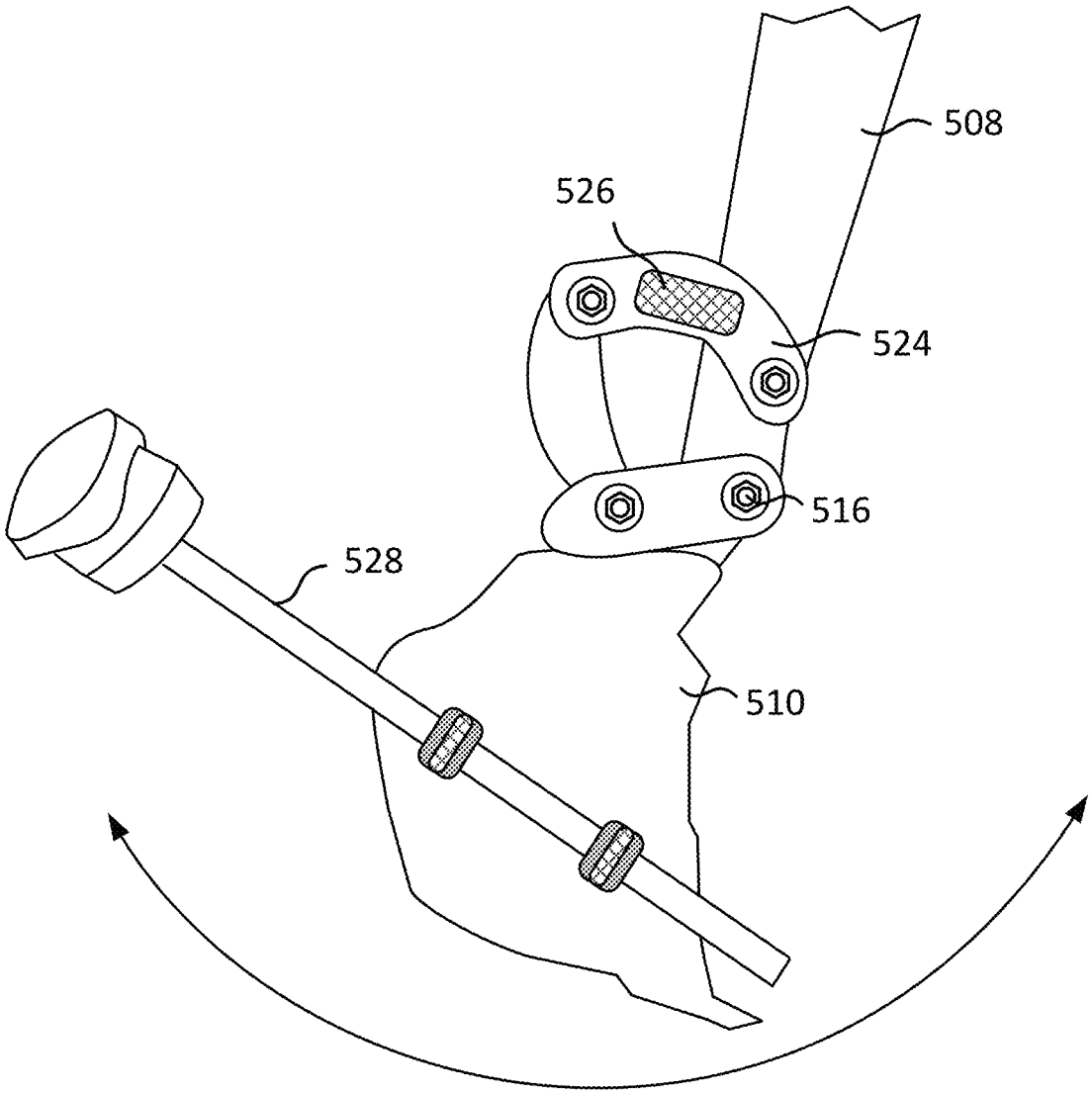
FIG. 5 is a simplified side view of a bucket of an excavator with a tilt compensating survey pole coupled to the bucket. This figure illustrates a step of curling the bucket in accordance with some embodiments.

This step can be illustrated with reference to FIG. 5, where a bucket 510 that is coupled to a stick 508 of an excavator is curled in and out. The bucket 510 is pivotally coupled to the stick 508 at a pivot point 516. A tilt compensating survey pole 528 is coupled to the bucket 510, and an IMU 526 is coupled to dog bone 524. The tilt compensating survey pole 528 may be removably coupled to the bucket 510 using mounts that provide a rigid coupling. In some embodiments, the stick 508 is static while the bucket 510 is curled in and out in step 202. The tilt compensating survey pole 528 may include one or more sensors (e.g., IMUs) for performing orientation and angular rate measurements and a GNSS receiver for performing position measurements. Note that the position measurements may not be used or may not be obtained during some steps.

While the bucket 510 is curled between the fully out and the fully in positions in step 202, measurements associated with the bucket 510 are obtained using the tilt compensating survey pole 528 and measurements associated with the dog bone 524 are obtained using the IMU 526 coupled to the dog bone 524. The measurements can be used for determining: (i) a relationship between an angle of the dog bone 524 and an angle of the bucket 510 relative to the stick 508 of the excavator, (ii) an axis of rotation of the pivot point 516 in a frame of the tilt compensating survey pole 528, and (iii) an axis of rotation of the dog bone 524 in a frame of the IMU 526 coupled to the dog bone 524. Note that additional measurements performed during step 206 (described below) with the tilt compensating survey pole coupled to the stick may also be used to determine the relationship between the angle of the dog bone and the angle of the bucket relative to the stick. Also note that reference in this description to an axis of rotation of the tilt compensating survey pole or to a frame of the tilt compensating survey pole is based on an IMU or one or more other sensors integrated with the tilt compensating survey pole and used for tilt compensation measurements.

In some embodiments, the same tilt compensating survey pole used in step 202 may also be used to measure a position of a point on the ground. The position of the point is used for other steps of the measure-up process described below and is also part of the data that enables the 3D positioning of the tip of the bucket. The position of the point is used for the measure-up process and is not necessary for the 3D positioning. The point can be on any surface and does not have to be on the ground. The position may be determined, for example, in three-dimensional coordinates, such as those provided in conventional survey measurements.

The measure-up process also includes a step of moving the stick of the excavator in toward a cab of the excavator and out away from the cab of the excavator multiple times, with the tilt compensating survey pole coupled to the stick and the IMU coupled to the dog bone (204). The same tilt compensating survey pole that was used in step 202 may be used in this step and the other steps of the measure-up process. The tilt compensating survey pole can be moved from the bucket for step 202 to the stick for step 204.

Figure 6:
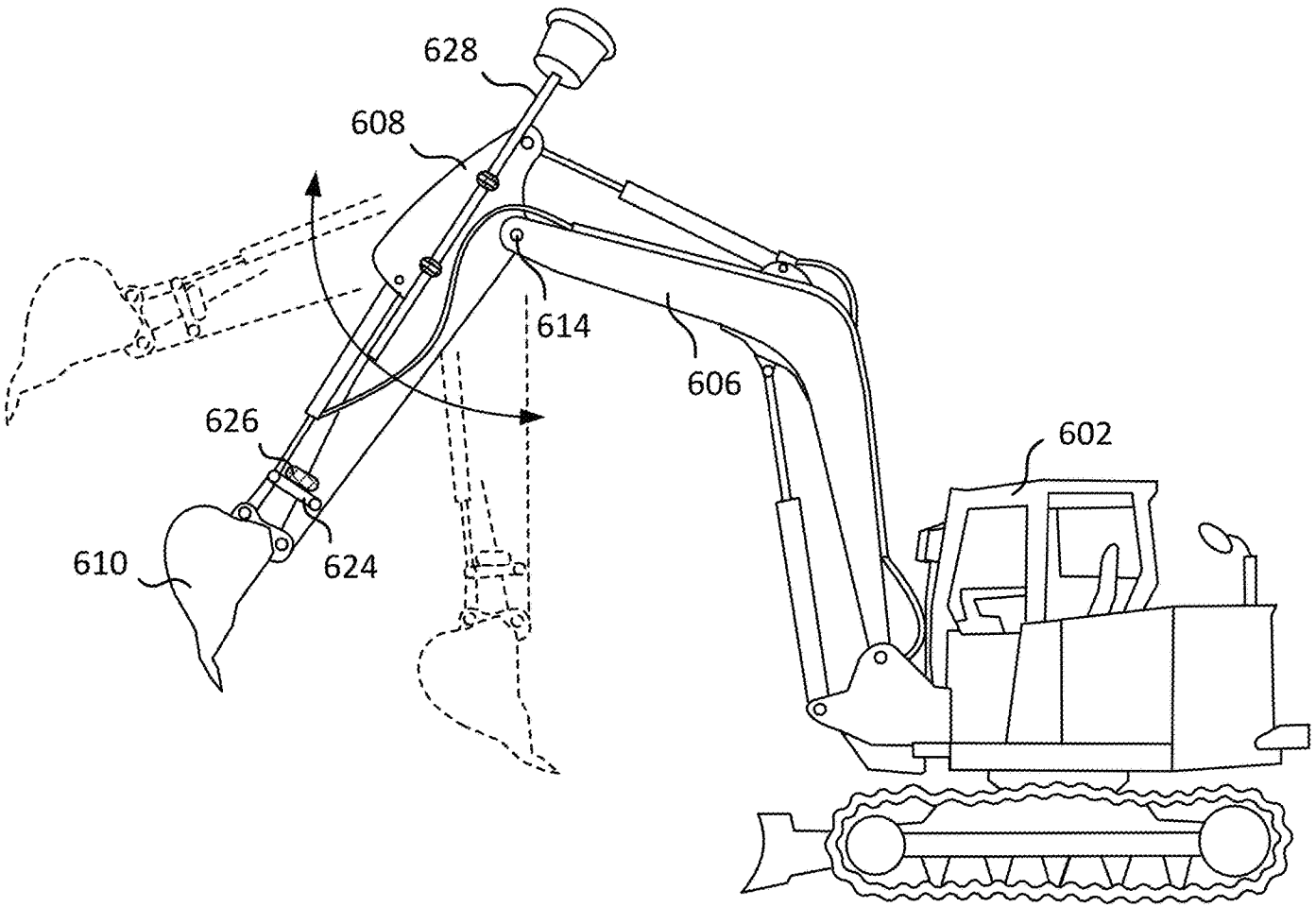
FIG. 6 is a simplified side view of an excavator with a tilt compensating survey pole coupled to a stick of the excavator. This figure illustrates a step of moving the stick in toward a cab of the excavator and out away from the cab of the excavator in accordance with some embodiments.

This step (204) can be illustrated with reference to FIG. 6, where a stick 608 of an excavator is moved in toward a cab 602 and out away from the cab 602. A tilt compensating survey pole 628 is coupled to the stick 608, and an IMU 626 is coupled to dog bone 624. The stick 608 is pivotally coupled to a boom 606 at a pivot point 614.

While the stick 608 is moved in and out in step 204, measurements associated with the stick 608 are obtained using the tilt compensating survey pole 628 and measurements associated with the dog bone 624 are obtained using the IMU 626. The measurements can be used in determining: (i) an axis of rotation of the pivot point 614 between the boom 606 and the stick 608 in a frame of the tilt compensating survey pole 628, and (ii) an axis of rotation of the pivot point 614 in a frame of the IMU 626.

The measure-up process also includes a step of curling the bucket of the excavator a second time between the fully out position and the fully in position multiple times, with the tilt compensating survey pole coupled to the stick and the IMU coupled to the dog bone (206). This step may be performed before or after curling the bucket the first time in step (202).

Figure 7A:
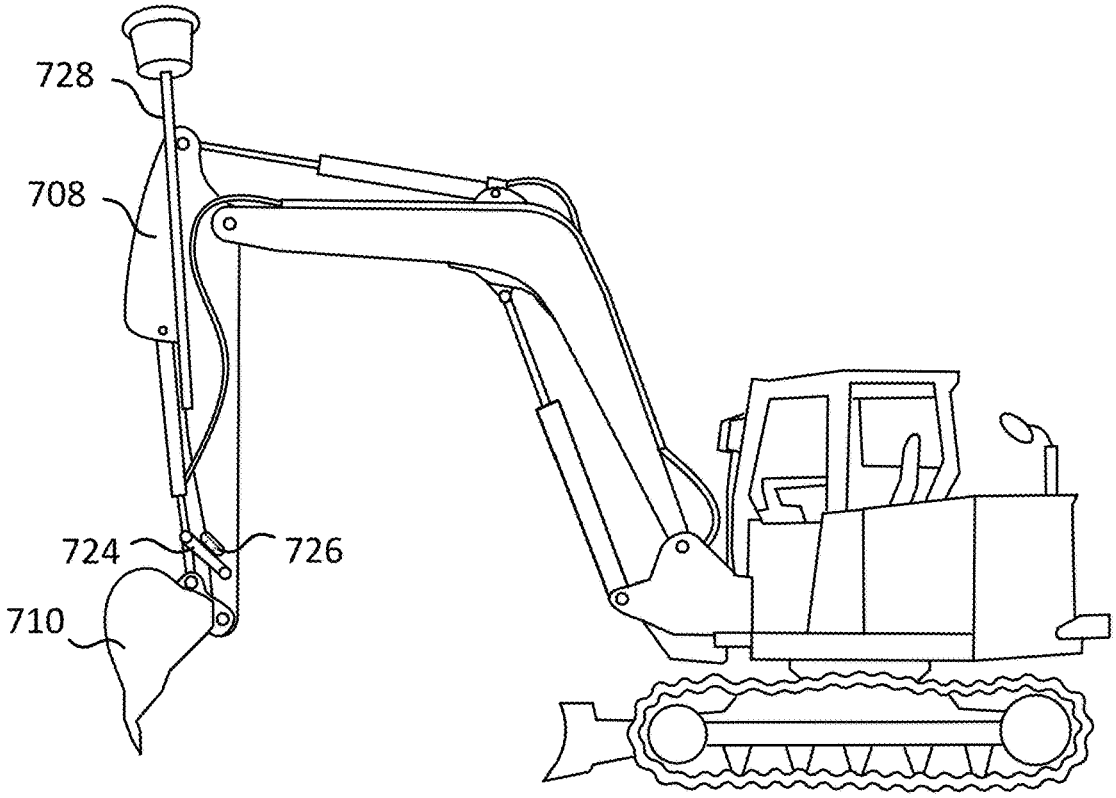
FIGS. 7A-7B are simplified side views of an excavator with a tilt compensating survey pole coupled to a stick of the excavator. These figures illustrate a step of curling the bucket in accordance with some embodiments.
Figure 7B:
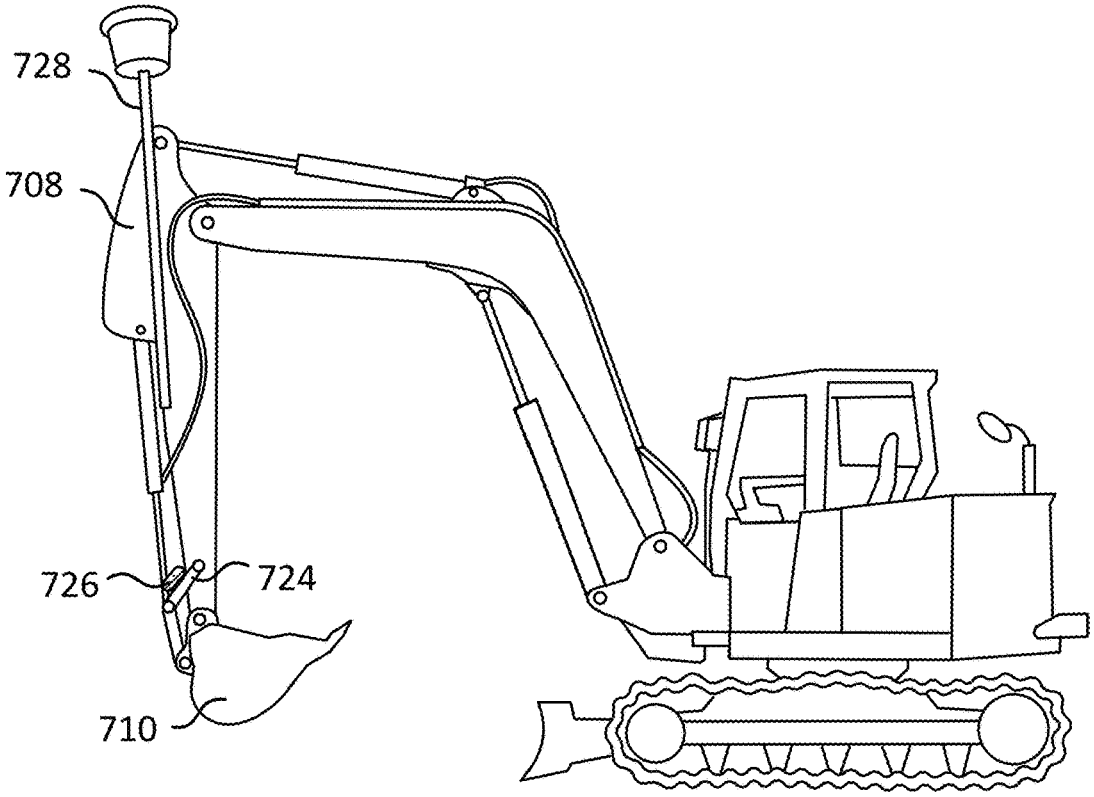

This step can be illustrated with reference to FIGS. 7A-7B, where a bucket 710 that is coupled to a stick 708 of an excavator is curled in and out. A tilt compensating survey pole 728 is coupled to the stick 708, and an IMU 726 is coupled to dog bone 724. In FIG. 7A the bucket 710 is in a curled out position, and in FIG. 7B the bucket 710 is in a curled in position. These figures also show how an angle of the dog bone 724 changes as an angle of the bucket 710 is changed relative to the stick 708.

While the bucket 710 is curled between the fully out and fully in positions in step 206, measurements associated with the stick 708 are obtained using the tilt compensating survey pole 728, and measurements associated with the dog bone 724 are obtained using the IMU 726. The measurements can be used in determining: (i) a pitch of the dog bone 724 relative to the stick 708 when fully curled in, and (ii) the pitch of the dog bone 724 relative to the stick 708 when fully curled out. Optionally, the measurements can also be used in determining a range of pitch motion of the dog bone 724 relative to the stick 708.

The measure-up process also includes a step of moving the bucket so that a tip of the bucket touches a point at multiple different bucket angles, with the tilt compensating survey pole coupled to the stick and the IMU coupled to the dog bone (208). The point may be the point on the ground, and this step may be performed before or after measuring the position of the point on the ground (described above). In some embodiments, the point may be at a known position that does not require a separate measurement.

Figure 8A:
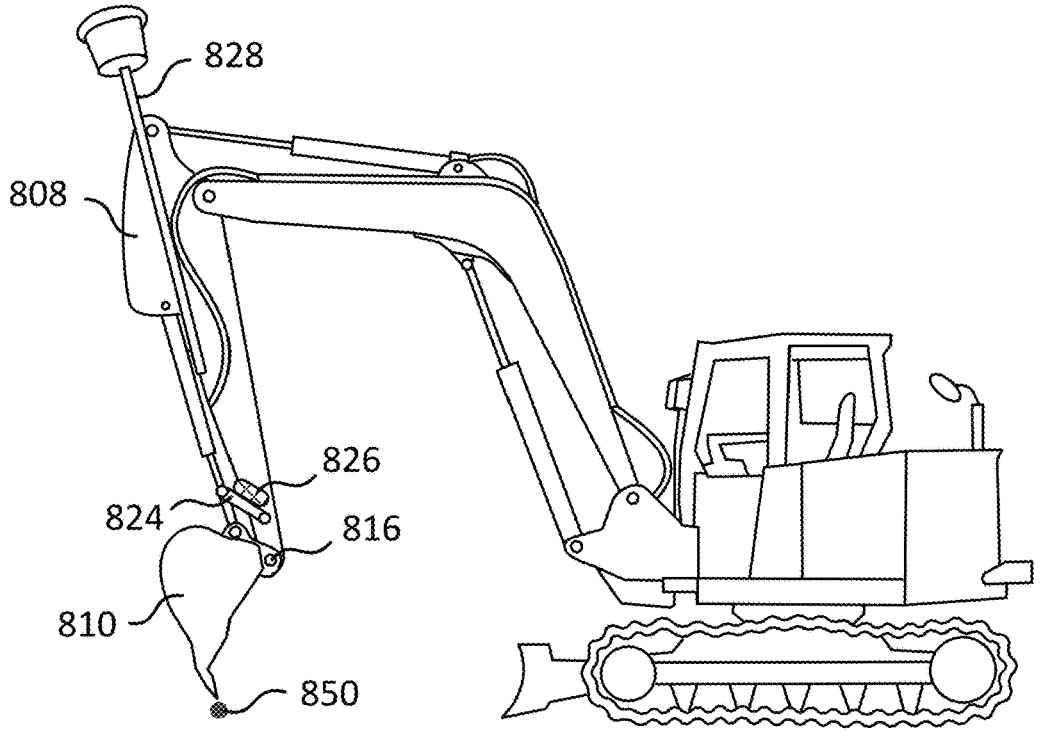
FIGS. 8A-8C are simplified side views of an excavator with a tilt compensating survey pole coupled to a stick of the excavator. These figures illustrate a step of moving the bucket so that a tip of the bucket touches a point at multiple different bucket angles in accordance with some embodiments.
Figure 8B:
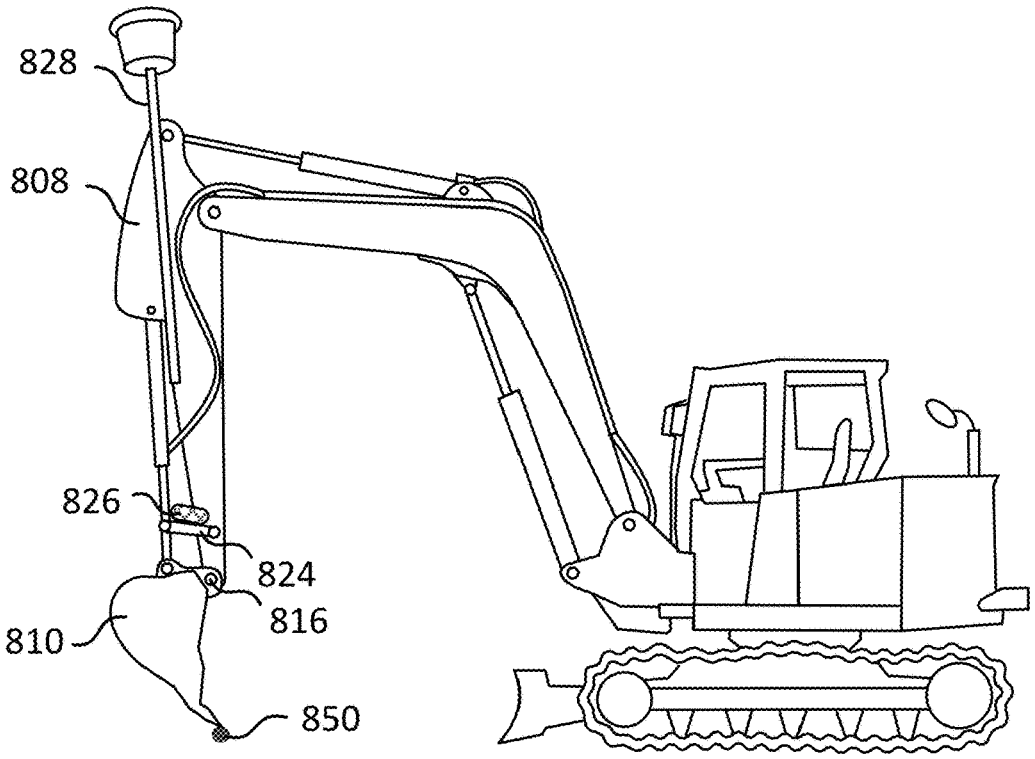
Figure 8C:
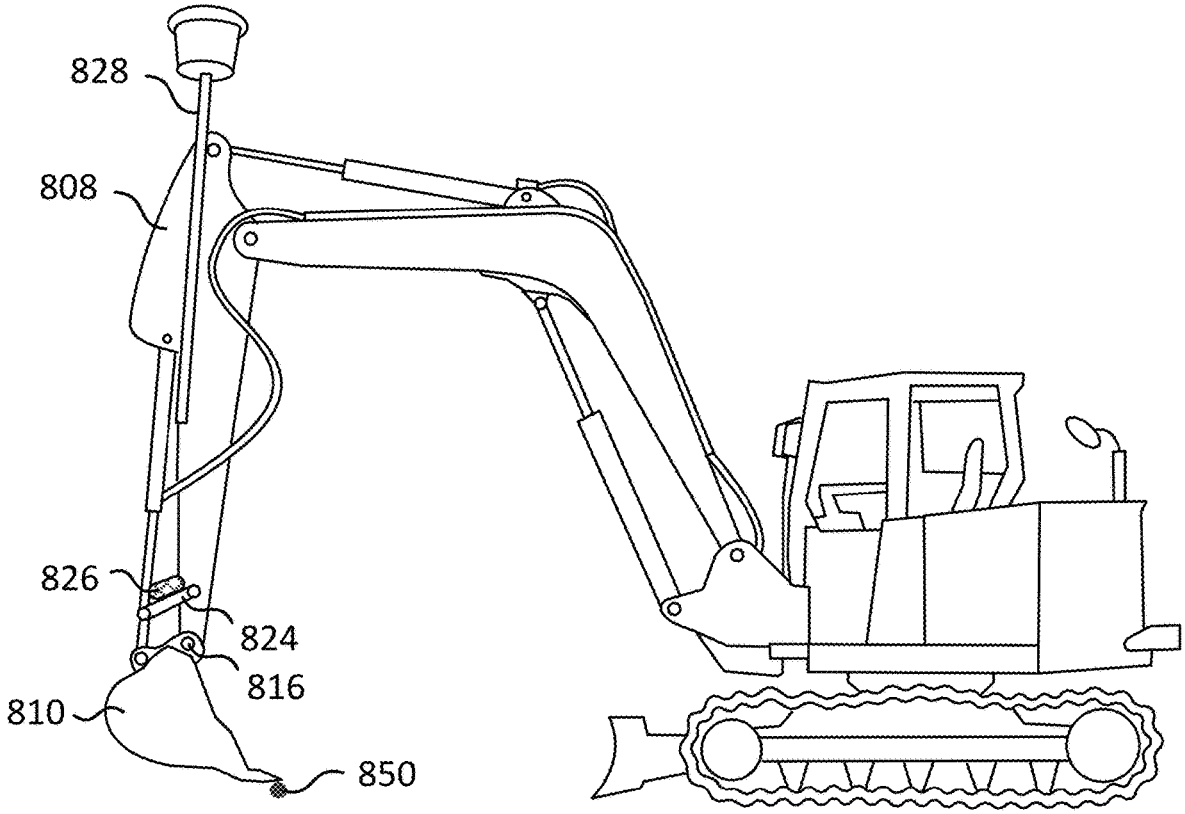

This step can be illustrated with reference to FIGS. 8A-8C, where a bucket 810 that is coupled to a stick 808 of an excavator is moved so that a tip of the bucket 810 touches a point 850 at multiple different bucket angles. A tilt compensating survey pole 828 is coupled to the stick 808, and an IMU 826 is coupled to dog bone 824. The bucket angle is different in each of FIGS. 8A-8C. As with FIGS. 7A-7B, these figures also show how an angle of the dog bone 824 changes as an angle of the bucket 810 is changed relative to the stick 808.

While moving the bucket 810 and touching the point 850 at the different bucket angles in step 208, measurements associated with the stick 808 are obtained using the tilt compensating survey pole 828, including position measurements as the bucket 810 touches the point 850 at each of the different bucket angles, and measurements associated with the dog bone 824 are obtained using the IMU 826. The measurements can be used in determining: (i) a position of a pivot point 816 between the stick 808 and the bucket 810 relative to a measurement center (e.g., a phase center of a GNSS antenna) of the tilt compensating survey pole 828, and (ii) a position of the tip of the bucket 810 relative to the pivot point 816 in a frame with orientation derived from the tilt compensating survey pole in step 202.

The measure-up process also includes determining a distance between the tip of the bucket 810 and the pivot point 816 between the stick 808 and the bucket 810, determining a lateral distance between a centerline of the stick 808 and the measurement center (e.g., a phase center of a GNSS antenna) of the tilt compensating survey pole 828, and determining a width of the tip of the bucket 810. In some embodiments, an operator may measure these distances manually (e.g., using a measuring tape). However, these distances may be measured or determined by any means, and they are part of the data that enables the 3D positioning of the tip of the bucket. In some embodiments, the distances are measured and provided as inputs to an implement guidance system.

The measure-up process also includes a step for generating the data that enables the 3D positioning of the tip of the bucket. The data is generated using the position measurements obtained using the tilt compensating survey pole, the orientation and angular rate measurements obtained using the tilt compensating survey pole, and the IMU measurements obtained using the IMU coupled to the dog bone (210). In some embodiments, the data may be generated using at least some of the following values and relationships:

- the relationship between the angle of the dog bone and the angle of the bucket relative to the stick;
- the axis of rotation of the pivot point between the stick and the bucket in the frame of the tilt compensating survey pole coupled to the bucket;
- the axis of rotation of the dog bone in the frame of the IMU coupled to the dog bone;
- the position of the point on the ground;
- the axis of rotation of the pivot point between the boom and the stick in a frame of the tilt compensating survey pole coupled to the stick;
- the pitch of the dog bone relative to the stick when fully curled in and the pitch of the dog bone relative to the stick when fully curled out;
- the position of the pivot point between the stick and the bucket relative to the measurement center of the tilt compensating survey pole coupled to the stick;
- the position of the tip of the bucket relative to the pivot point between the stick and the bucket in a frame of the tilt compensating survey pole coupled to the bucket;
- the distance between the tip of the bucket and the pivot point between the stick and the bucket;
- the lateral distance between the centerline of the stick and the measurement center of the tilt compensating survey pole; and
- the width of the tip of the bucket.

The data generated in step 210 that enables the 3D positioning of the tip of the bucket may include at least some of the following values and relationships:

a rotation matrix defining a relationship between a frame of the tilt compensating survey pole coupled to the stick and a frame aligned with the axis of rotation of the pivot point between the boom and the stick;

a rotation matrix defining a relationship between a frame of the IMU coupled to the dog bone and a frame aligned with the axis of rotation of the pivot point between the stick and the dog bone;

the pitch of the dog bone relative to the stick when fully curled in and the pitch of the dog bone relative to the stick when fully curled out;

a relationship between the angle of the dog bone and the angle of the bucket relative to the stick, where the angle of the bucket is measured to a line formed by joining the tip of the bucket and the pivot point between the stick and the bucket;

the lateral distance between the centerline of the stick and the measurement center of the tilt compensating survey pole;

the width of the bucket tip;

the distance between the tip of the bucket and the pivot point between the stick and the bucket; and a position of the pivot point between the stick and the bucket relative to the measurement center of the tilt compensating survey pole coupled to the stick.

Figure 3:
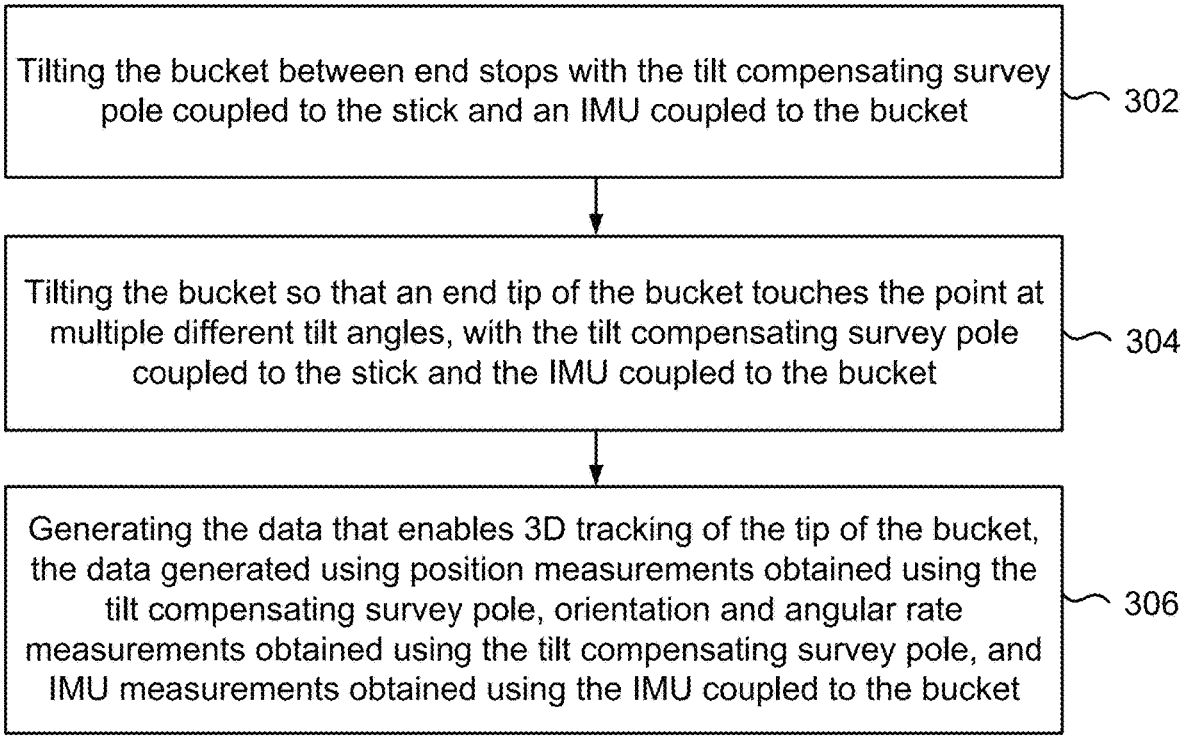

The exemplary measure-up process illustrated in the flowchart of FIG. 2 can be used to provide data that enables 3D positioning of a tip of a bucket if a tilt (roll) of the bucket is fixed. For buckets that both curl and tilt, FIG. 3 is a flowchart illustrating steps of an exemplary measure-up process that, along with the steps of FIG. 2, can be used to provide data that enables 3D positioning of the tip of the bucket in accordance with some embodiments.

For curling and tilting buckets, the measure-up process also includes a step of tilting the bucket between end stops with the survey pole coupled to the stick and an IMU coupled to the bucket (302). The IMU coupled to the bucket can be separate from the IMU coupled to the dog bone in the steps of FIG. 2. Alternatively, the IMU coupled to the dog bone can be moved to the bucket for the steps of FIG. 3.

Figure 9:
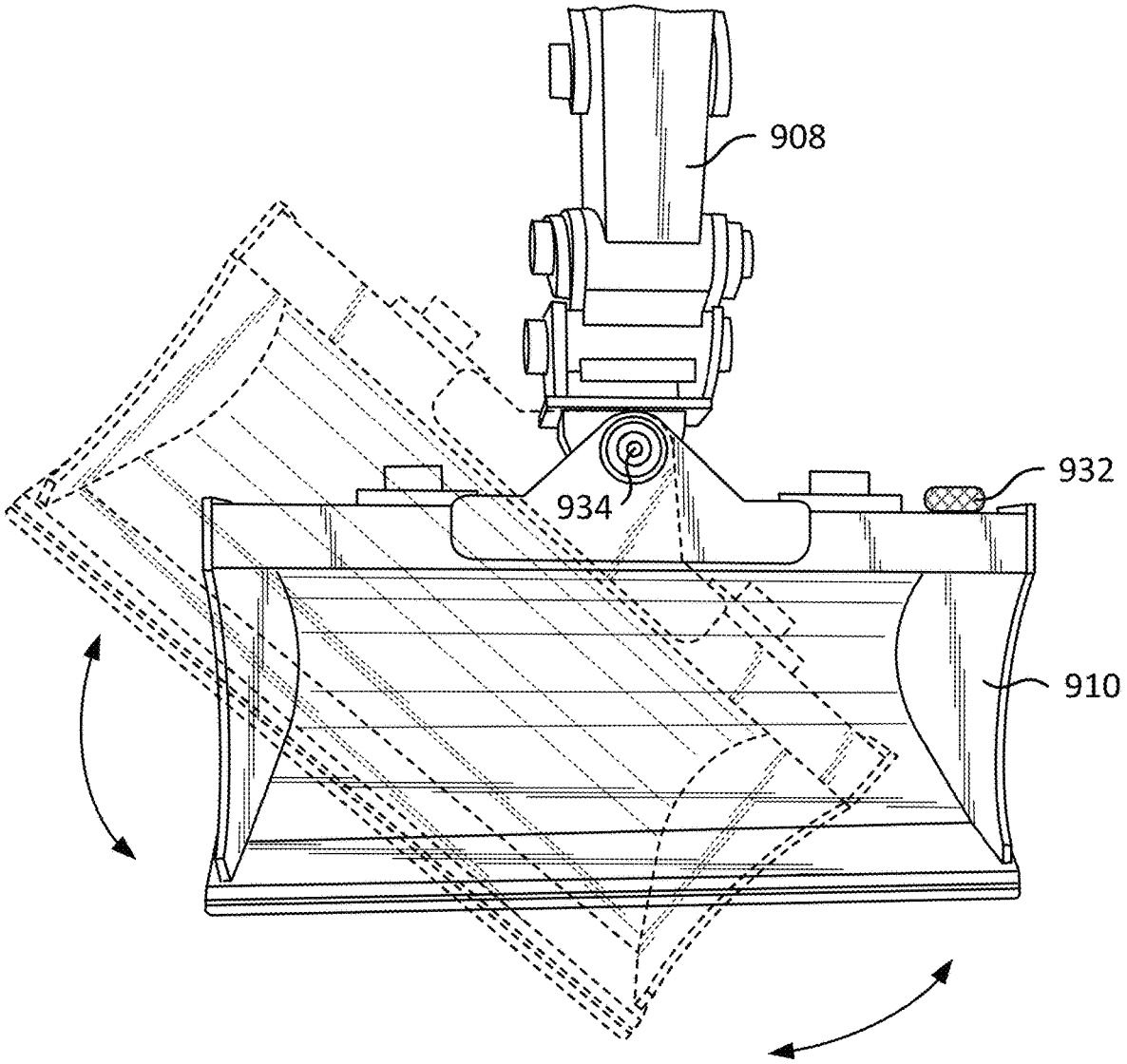
FIG. 9 is a simplified view of a tilting bucket of an excavator as seen from a cab. This figure illustrates a step of tilting the bucket in accordance with some embodiments.

Step 302 can be illustrated with reference to FIG. 9, where a bucket 910 of an excavator is tilted left and right about a hinge point 934 that enables the tilt of the bucket 910. This figure is a simplified view of a tilting bucket 910 of an excavator as seen from a cab as opposed to the side views in the previous figures. A tilt compensating survey pole is coupled to the stick 908 and an IMU 932 is coupled to the bucket 910.

While the bucket 910 is tilted between end stops, measurements associated with the bucket 910 are obtained using the IMU 932 coupled to the bucket 910, and measurements associated with the stick 908 are obtained using the tilt compensating survey pole. The measurements can be used in determining: (i) an axis of rotation of the hinge point 934 in a frame of the IMU 932 coupled to the bucket 910, and (ii) the tilt of the bucket 910 at the end stops.

The measure-up process also includes a step of tilting the bucket so that an end tip of the bucket touches the point at multiple different tilt angles, with the GNSS survey pole coupled to the stick and the IMU coupled to the bucket (304). The point in step 304 can be the same point as step 208 or a different point at a known (or measured) position.

Figure 10A:
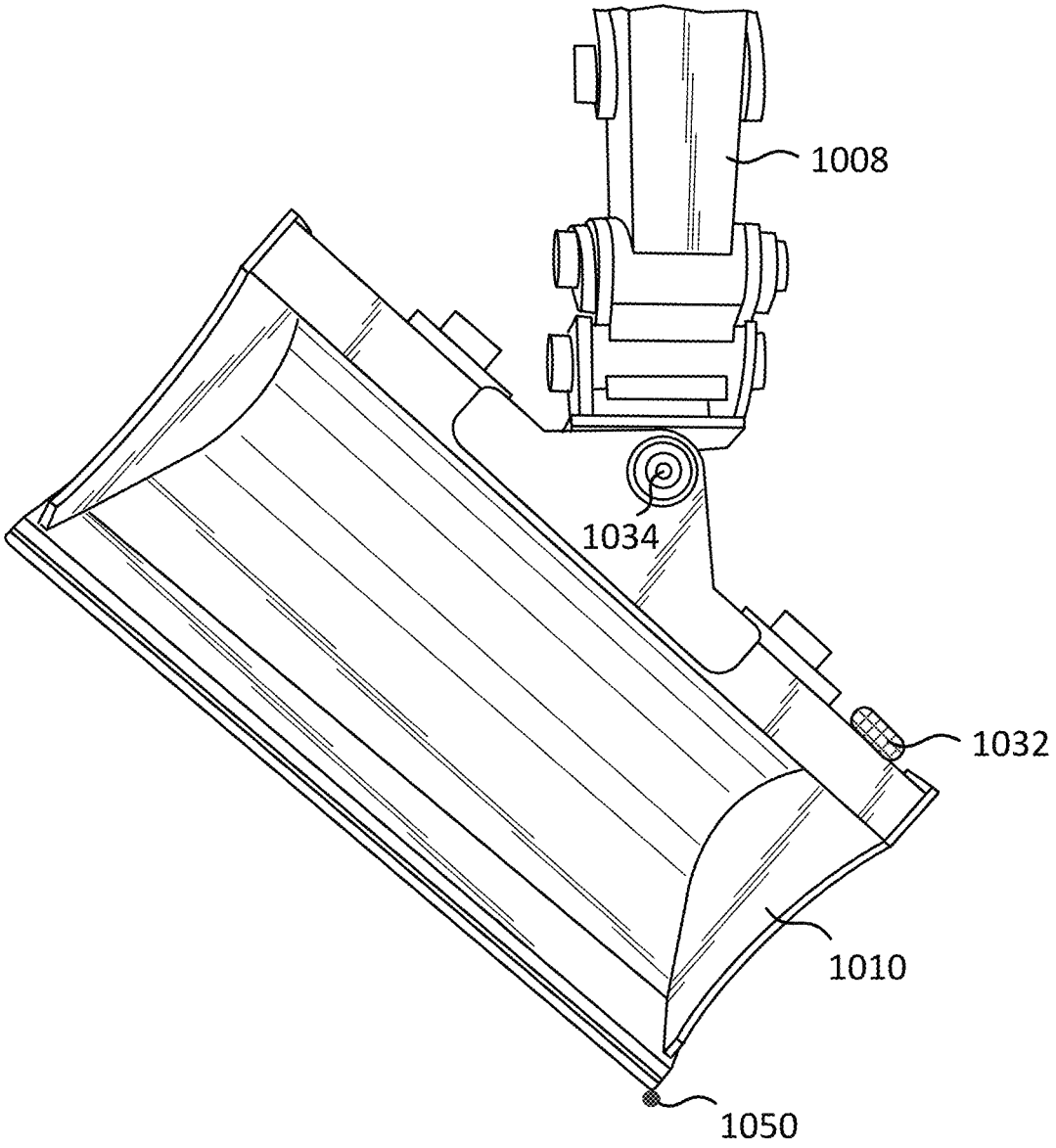
FIGS. 10A-10B are simplified views of a tilting bucket of an excavator as seen from a cab. These figures illustrate a step of tilting the bucket so that an end tip of the bucket touches a point at multiple different tilt angles in accordance with some embodiments.
Figure 10B:
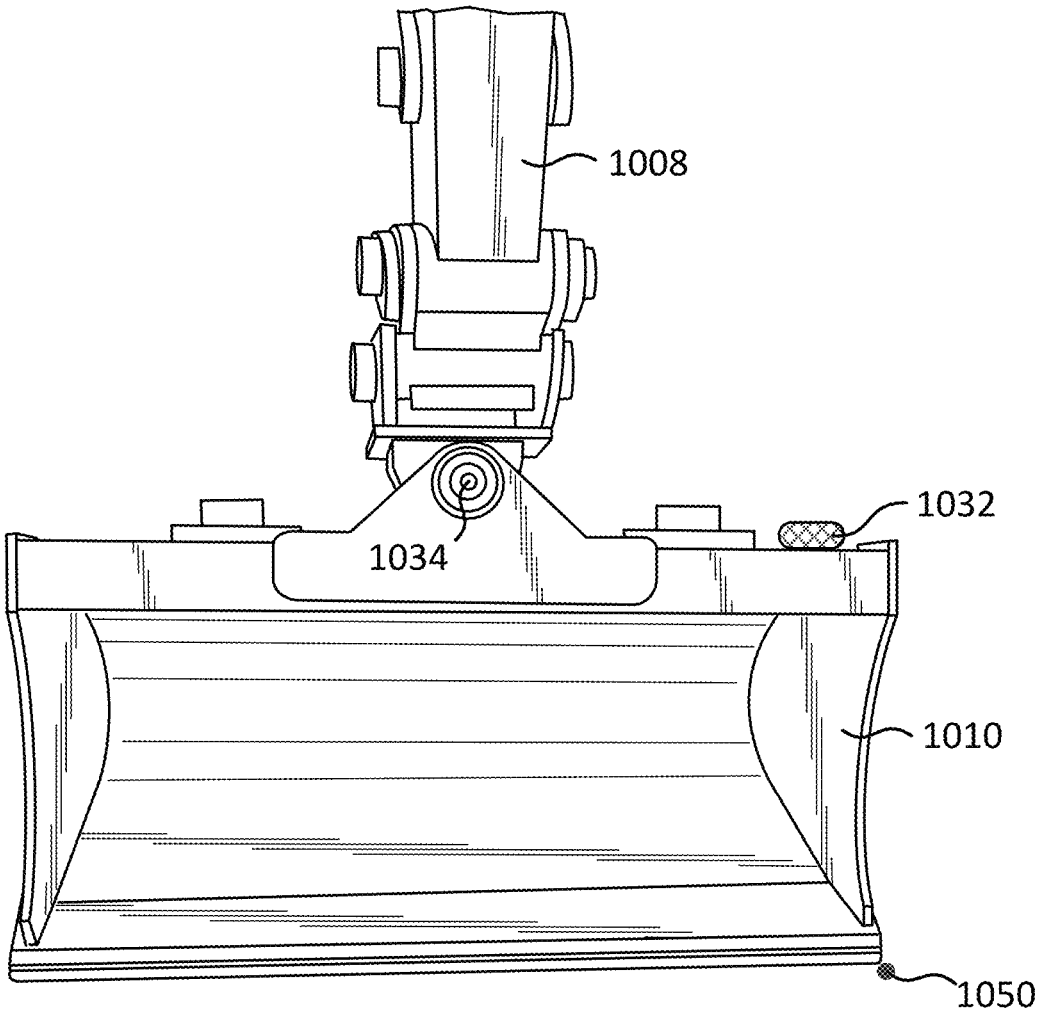

Step 304 can be illustrated with reference to FIGS. 10A-10B, where a bucket 1010 of an excavator is tilted so that an end tip of the bucket 1010 touches a point 1050 at multiple different tilt angles. The end tip may be a corner of the bucket 1010 (or a tooth on the bucket), or the end tip may be a side edge of the bucket 1010. Sometimes an end tip of the bucket 1010 may become worn and rounded, and more accurate results may be obtained using a side edge of the bucket 1010. During step 304, the tilt compensated survey pole is coupled to the stick 1008 of the excavator, as shown, for example, in FIGS. 8A-8C, and the IMU 1032 is coupled to the bucket 1010. The tilt angle of the bucket 1010 changes between FIGS. 10A-10B.

While the bucket 1010 is tilted so that the end tip of the bucket 1010 touches the point 1050 at multiple different tilt angles, measurements associated with the stick 1008 are obtained using the tilt compensating survey pole, including position measurements as the end tip of the bucket 1010 touches the point 1050 at each of the different tilt angles, and measurements associated with the bucket 1010 are obtained using the IMU 1032 coupled to the bucket. The measurements can be used in determining: (i) a position of the hinge point 1034 relative to the pivot point between the stick 1008 and the bucket 1010, and (ii) a position of the tip of the bucket 1010 relative to the hinge point 1034.

The measure-up process also includes determining a roll offset between the bucket and the IMU coupled to the bucket. The roll offset can be determined, for example, by leveling the bucket (tilt-wise) and determining a tilt of the IMU coupled to the bucket. An operator can level the bucket (tilt-wise) using a spirit level, for example.

The measure-up process also includes a step for generating the data that enables the 3D positioning of the tip of the bucket, the data generated using the position measurements obtained using the tilt compensating survey pole, the orientation and angular rate measurements obtained using the tilt compensating survey pole, and the IMU measurements obtained using the IMU coupled to the bucket (306). The data generated in step 306 may be used, along with the data generated in step 210, to enable 3D positioning of a tip of a bucket that curls and tilts. In some embodiments, the data may be generated using at least some of the following additional values and relationships:

the axis of rotation of the hinge point in a frame of the IMU coupled to the bucket;

the tilt of the bucket at the end stops;

the position of the hinge point relative to the pivot point between the stick and the bucket;

the position of the tip of the bucket relative to the hinge point; and the roll offset between the bucket and the IMU coupled to the bucket.

The data generated in step 304 that enables the 3D positioning of the tip of the bucket may include at least some of the following values and relationships:

a rotation matrix defining a relationship between a frame of the IMU coupled to the bucket and a frame aligned with the axis of rotation of the hinge point, as well as being aligned with the tip of the bucket;

the tilt of the bucket at the end stops;

the position of the hinge point relative to the pivot point between the stick and the bucket; and the position of the tip of the bucket relative to the hinge point.

Figure 4:
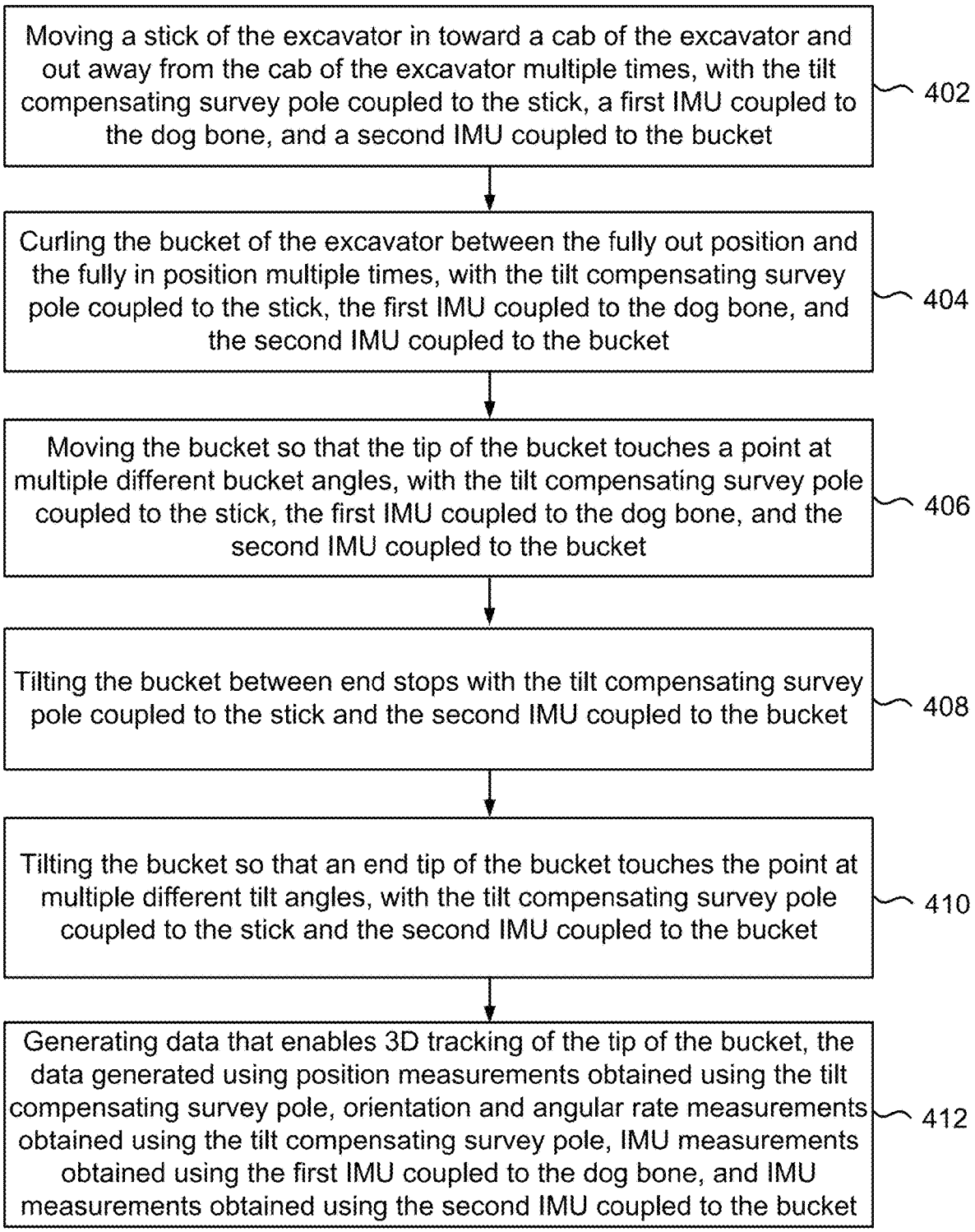

FIG. 4 is a flowchart illustrating an exemplary measure-up process used to provide data that enables 3D positioning of a tip of a bucket that curls and tilts in accordance with another embodiment. The measure-up process provided in this example is similar to the examples of FIGS. 2-3, but this process takes advantage of a tilt compensating survey pole coupled to a stick, a first IMU coupled to a dog bone, and a second IMU coupled to a bucket.

The measure-up process includes a step of moving the stick of the excavator in toward a cab and out away from the cab multiple times, with the tilt compensating survey pole coupled to the stick, the first IMU coupled to the dog bone, and the second IMU coupled to the bucket (402). This step is similar to step 204 in FIG. 2 with the additional IMU coupled to the bucket.

While the stick is moved in and out in step 402, measurements associated with the stick are obtained using the tilt compensating survey pole, measurements associated with the dog bone are obtained using the first IMU, and measurements associated with the bucket are obtained using the second IMU. The measurements can be used in determining: (i) an axis of rotation of a pivot point between the boom and the stick in a frame of the tilt compensating survey pole, (ii) a second axis of rotation of the pivot point between the boom and the stick in a frame of the first IMU coupled to the dog bone, and (iii) a third axis of rotation of the pivot point between the boom and the stick in a frame of the second IMU coupled to the bucket.

The measure-up process also includes a step of curling the bucket of the excavator between the fully out position and the fully in position multiple times, with the tilt compensating survey pole coupled to the stick, the first IMU coupled to the dog bone, and the second IMU coupled to the bucket (404). This step is similar to step 206 in FIG. 2 with the additional IMU coupled to the bucket.

While the bucket is curled between the fully out and fully in positions in step 404, measurements associated with the stick are obtained using the tilt compensating survey pole, measurements associated with the dog bone are obtained using the first IMU, and measurements associated with the bucket are obtained using the second IMU. The measurements can be used in determining: (i) a pitch of the dog bone relative to the stick when fully curled in, (ii) the pitch of the dog bone relative to the stick when fully curled out, and (iii) a relationship between an angle of the dog bone and an angle of the bucket relative to the stick of the excavator. Optionally, the measurements can also be used in determining a range of pitch motion of the dog bone relative to the stick. Alternatively, the range of pitch motion of the dog bone relative to the stick can be determined using: (i) the pitch of the dog bone relative to the stick when fully curled in, and (ii) the pitch of the dog bone relative to the stick when fully curled out.

The measure-up process also includes a step of moving the bucket so that a tip of the bucket touches a point at multiple different bucket angles, with the tilt compensating survey pole coupled to the stick, the first IMU coupled to the dog bone, and the second IMU coupled to the bucket (406). This step is similar to step 208 in FIG. 2 with the additional IMU coupled to the bucket. Like step 208, the point may be a point on the ground whose position is measured using the tilt compensating survey pole, and this step may be performed before or after measuring the position of the point on the ground. In some embodiments, the point may be at a known position that does not require a separate measurement.

While moving the bucket and touching the point at the different bucket angles in step 406, measurements associated with the stick are obtained using the tilt compensating survey pole, including position measurements as the bucket touches the point at each of the different bucket angles, measurements associated with the dog bone that are obtained using the first IMU, and measurements associated with the bucket that are obtained using the second IMU. The measurements can be used in determining a position of a pivot point between the stick and the bucket relative to a measurement center (e.g., a phase center of a GNSS antenna) of the tilt compensating survey pole. Note that additional measurements performed during step 410 (described below) may be used in conjunction with the measurements performed in step 406 to determine the position of a pivot point between the stick and the bucket, the position of the hinge point relative to the pivot point, and the bucket tip relative to the hinge point.

The measure-up process also includes determining a distance between the tip of the bucket and the pivot point between the stick and the bucket, determining a lateral distance between a centerline of the stick and the measurement center (e.g., the phase center of the GNSS antenna) of the tilt compensating survey pole, and determining a width of the tip of the bucket. In some embodiments, an operator may measure these distances manually (e.g., using a measuring tape). However, these distances may be measured or determined by any means, and they are part of the data that enables the 3D positioning of the tip of the bucket. In some embodiments, the distances are measured and provided as inputs to an implement guidance system. In some embodiments the tilt of the bucket relative to the stick is substantially zero (e.g., no more than a few degrees) when determining the distance between the tip of the bucket and the pivot point between the stick and the bucket.

The measure-up process also includes a step of tilting the bucket between end stops with the second IMU coupled to the bucket (408). This step is similar to step 302 in FIG. 3.

While the bucket is tilted between end stops, measurements associated with the bucket are obtained using the second IMU, and measurements associated with the stick are obtained using the tilt compensating survey pole. The measurements can be used in determining: (i) an axis of rotation of the hinge point that enables the tilt of the bucket in a frame of the IMU coupled to the bucket, and (ii) the tilt of the bucket at the end stops.

The measure-up process also includes a step of tilting the bucket so that an end tip of the bucket touches the point at multiple different tilt angles, with the GNSS survey pole coupled to the stick and the second IMU coupled to the bucket (410). The end tip may be a corner of the bucket (or a tooth on the bucket), or the end tip may be a side edge of the bucket. The point in step 410 can be the same point as step 406 or a different point at a known (or measured) position. This step is similar to step 304 in FIG. 3.

While the bucket is tilted so that the end tip of the bucket touches the point at multiple different tilt angles, measurements associated with the stick are obtained using the tilt compensating survey pole, including position measurements as the end tip of the bucket touches the point at each of the different tilt angles, and measurements associated with the bucket are obtained using the second IMU. The measurements can be used in determining: (i) a position of the hinge point relative to the pivot point between the stick and the bucket, and (ii) a position of the tip of the bucket relative to the hinge point.

The measure-up process also includes determining a roll offset between the bucket and the second IMU. The roll offset can be determined, for example, by leveling the bucket (tilt-wise) and determining a tilt of the second IMU. An operator can level the bucket (tilt-wise) using a spirit level, for example.

The measure-up process also includes a step of generating the data that enables the 3D positioning of the tip of the bucket, the data generated using the position measurements obtained using the tilt compensating survey pole, the orientation and angular rate measurements obtained using the tilt compensating survey pole, the IMU measurements obtained using the first IMU coupled to the dog bone, and IMU measurements obtained using the second IMU coupled to the bucket (412). The data generated in step 412 may be used to enable 3D positioning of a tip of a bucket that curls and tilts. In some embodiments, the data may be generated using at least some of the following values and relationships:

- the position of the point on the ground;
- the axis of rotation of the pivot point between the boom and the stick in a frame of the tilt compensating survey pole;
- the axis of rotation of the dog bone in the frame of the first IMU coupled to the dog bone;
- the pitch of the dog bone relative to the stick when fully curled in and the pitch of the dog bone relative to the stick when fully curled out;
- the relationship between the angle of the dog bone and the angle of the bucket relative to the stick;
- the position of the pivot point between the stick and the bucket relative to the measurement center of the tilt compensating survey pole;
- the distance between the tip of the bucket and the pivot point between the stick and the bucket;
- the lateral distance between the centerline of the stick and the measurement center of the tilt compensating survey pole;
- the width of the tip of the bucket;
- the axis of rotation of the hinge point in a frame of the second IMU coupled to the bucket;
- the tilt of the bucket at the end stops;
- the position of the hinge point relative to the pivot point between the stick and the bucket;
- the position of the tip of the bucket relative to the hinge point; and
- the roll offset between the bucket and the IMU coupled to the bucket.

It should be appreciated that the specific steps illustrated in FIGS. 2-4 provide particular measure-up processes according to some embodiments. Other sequences of steps may also be performed according to alternative embodiments. For example, some embodiments may perform the steps outlined above in a different order. Moreover, some of the individual steps illustrated in FIGS. 2-4 may be optional and/or may include multiple sub-steps that may be performed in various sequences. Furthermore, additional steps may be added or removed depending on the particular application.

The data generated using the measure-up processes illustrated in FIGS. 2-4 may be used by an implement guidance system that is integrated with or executed by a computer system of the excavator. In some embodiments, the implement guidance system may be configured to use the data along with hardware controls to automatically control movement of the bucket relative to a planned design. In other embodiments, the implement guidance system may use the data to indicate to an operator how close the tip of the bucket is to the planned design. This allows the operator to manually control the bucket according to the planned design. In other implementations, the implement guidance system may be integrated with a handheld computer system associated with the GNSS survey pole, or the implement guidance system may be an application configured to run on a mobile computer system (e.g., a tablet or cell phone).

Figure 11:
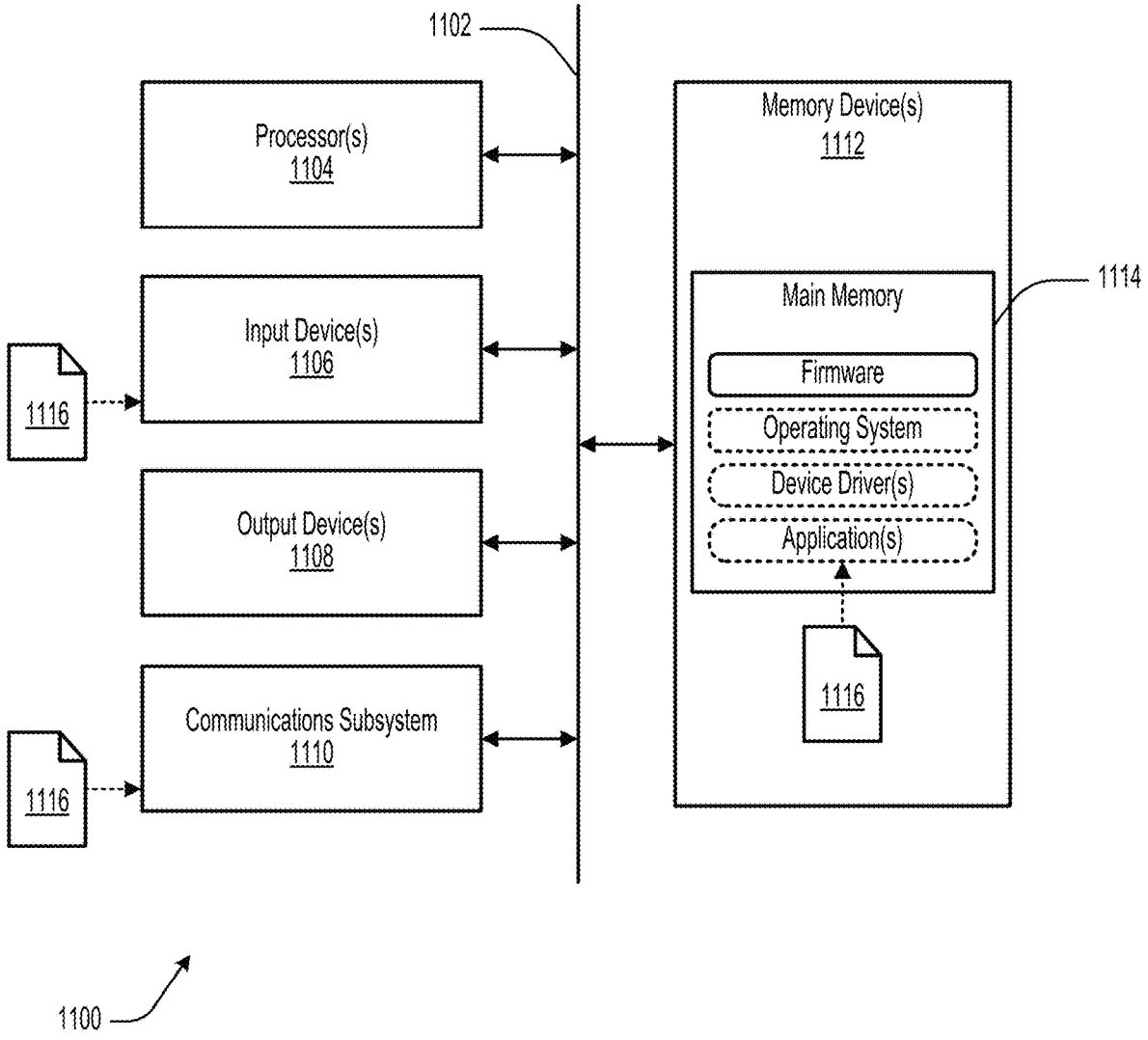
FIG. 11 is a simplified block diagram of an exemplary computer system in accordance with some embodiments.

FIG. 11 is a simplified block diagram of an exemplary computer system in accordance with some embodiments. Computer system 1100 may be incorporated into or integrated with devices and systems described herein (e.g., excavators, implement guidance systems) and/or may be configured to perform some or all of the steps of the methods and processes provided by the various embodiments. For example, in various embodiments, computer system 1100 may be configured to perform the steps illustrated in FIGS. 2-4. It should be noted that FIG. 11 is meant only to provide a generalized illustration of various components, any or all of which may be utilized as appropriate. FIG. 11, therefore, broadly illustrates how individual system elements may be implemented in a relatively separated or relatively more integrated manner.

In the illustrated example, computer system 1100 includes a communication medium 1102, one or more processor(s) 1104, one or more input device(s) 1106, one or more output device(s) 1108, a communications subsystem 1110, and one or more memory device(s) 1112. Computer system 1100 may be implemented using various hardware implementations and embedded system technologies. For example, one or more elements of computer system 1100 may be implemented as a field-programmable gate array (FPGA), such as those commercially available by XILINX®, INTEL®, or LATTICE SEMICONDUCTOR®, a system-on-a-chip (SoC), an application-specific integrated circuit (ASIC), an application-specific standard product (ASSP), a microcontroller, and/or a hybrid device, such as an SoC FPGA, among other possibilities.

The various hardware elements of computer system 1100 may be coupled via communication medium 1102. While communication medium 1102 is illustrated as a single connection for purposes of clarity, it should be understood that communication medium 1102 might include various numbers and types of communication media for transferring data between hardware elements. For example, communication medium 1102 may include one or more wires (e.g., conductive traces, paths, or leads on a printed circuit board (PCB) or integrated circuit (IC), microstrips, striplines, coaxial cables), one or more optical waveguides (e.g., optical fibers, strip waveguides), and/or one or more wireless connections or links (e.g., infrared wireless communication, radio communication, microwave wireless communication), among other possibilities.

In some embodiments, communication medium 1102 may include one or more buses connecting pins of the hardware elements of computer system 1100. For example, communication medium 1102 may include a bus connecting processor(s) 1104 with main memory 1114, referred to as a system bus, and a bus connecting main memory 1114 with input device(s) 1106 or output device(s) 1108, referred to as an expansion bus. The system bus may consist of several elements, including an address bus, a data bus, and a control bus. The address bus may carry a memory address from processor(s) 1104 to the address bus circuitry associated with main memory 1114 in order for the data bus to access and carry the data contained at the memory address back to processor(s) 1104. The control bus may carry commands from processor(s) 1104 and return status signals from main memory 1114. Each bus may include multiple wires for carrying multiple bits of information and each bus may support serial or parallel transmission of data.

Processor(s) 1104 may include one or more central processing units (CPUs), graphics processing units (GPUs), neural network processors or accelerators, digital signal processors (DSPs), and/or the like. A CPU may take the form of a microprocessor, which is fabricated on a single IC chip of metal-oxide-semiconductor field-effect transistor (MOSFET) construction. Processor(s) 1104 may include one or more multi-core processors, in which each core may read and execute program instructions simultaneously with the other cores.

Input device(s) 1106 may include one or more of various user input devices, such as a mouse, a keyboard, a microphone, as well as various sensor input devices, such as an image capture device, a pressure sensor (e.g., barometer, tactile sensor), a temperature sensor (e.g., thermometer, thermocouple, thermistor), a movement sensor (e.g., accelerometer, gyroscope, tilt sensor, IMU), a light sensor (e.g., photodiode, photodetector, charge-coupled device), a position sensor (e.g., GNSS antenna, GNSS receiver), and/or the like. Input device(s) 1106 may also include devices for reading and/or receiving removable storage devices or other removable media. Such removable media may include optical discs (e.g., Blu-ray discs, DVDs, CDs), memory cards (e.g., CompactFlash card, Secure Digital (SD) card, Memory Stick), floppy disks, Universal Serial Bus (USB) flash drives, external hard disk drives (HDDs) or solid-state drives (SSDs), and/or the like.

Output device(s) 1108 may include one or more of various devices that convert information into human-readable form, such as, without limitation, a display device, a speaker, a printer, and/or the like. Output device(s) 1108 may also include devices for writing to removable storage devices or other removable media, such as those described in reference to input device(s) 1106. Output device(s) 1108 may also include various actuators for causing physical movement of one or more components. Such actuators may be hydraulic, pneumatic, electric, and may be provided with control signals by computer system 1100.

Communications subsystem 1110 may include hardware components for connecting computer system 1100 to systems or devices that are located external to computer system 1100, such as over a computer network. In various embodiments, communications subsystem 1110 may include a wired communication device coupled to one or more input/output ports (e.g., a universal asynchronous receiver-transmitter (UART)), an optical communication device (e.g., an optical modem), an infrared communication device, a radio communication device (e.g., a wireless network interface controller, a BLUETOOTH® device, an IEEE 802.11 device, a Wi-Fi device, a Wi-Max device, a cellular device), among other possibilities.

Memory device(s) 1112 may include the various data storage devices of computer system 1100. For example, memory device(s) 1112 may include various types of computer memory with various response times and capacities, from faster response times and lower capacity memory, such as processor registers and caches (e.g., L0, L1, L2), to medium response time and medium capacity memory, such as random access memory, to lower response times and lower capacity memory, such as solid state drives and hard drive disks. While processor(s) 1104 and memory device(s) 1112 are illustrated as being separate elements, it should be understood that processor(s) 1104 might include varying levels of on-processor memory, such as processor registers and caches that may be utilized by a single processor or shared between multiple processors.

Memory device(s) 1112 may include main memory 1114, which may be directly accessible by processor(s) 1104 via the memory bus of communication medium 1102. For example, processor(s) 1104 may continuously read and execute instructions stored in main memory 1114. As such, various software elements may be loaded into main memory 1114 to be read and executed by processor(s) 1104 as illustrated in FIG. 11. Typically, main memory 1114 is volatile memory, which loses all data when power is turned off and accordingly needs power to preserve stored data. Main memory 1114 may further include a small portion of non-volatile memory containing software (e.g., firmware, such as BIOS) that is used for reading other software stored in memory device(s) 1112 into main memory 1114. In some embodiments, the volatile memory of main memory 1114 is implemented as random-access memory (RAM), such as dynamic RAM (DRAM), and the non-volatile memory of main memory 1114 is implemented as read-only memory (ROM), such as flash memory, erasable programmable read-only memory (EPROM), or electrically erasable programmable read-only memory (EEPROM).

Computer system 1100 may include software elements, shown as being currently located within main memory 1114, which may include an operating system, device driver(s), firmware, compilers, and/or other code, such as one or more application programs, which may include computer programs provided by various embodiments of the present disclosure. Merely by way of example, one or more steps described with respect to any methods discussed above, might be implemented as instructions 1116, executable by computer system 1100. In one example, such instructions 1116 may be received by computer system 1100 using communications subsystem 1110 (e.g., via a wireless or wired signal carrying instructions 1116), carried by communication medium 1102 to memory device(s) 1112, stored within memory device(s) 1112, read into main memory 1114, and executed by processor(s) 1104 to perform one or more steps of the described methods. In another example, instructions 1116 may be received by computer system 1100 using input device(s) 1106 (e.g., via a reader for removable media), carried by communication medium 1102 to memory device(s) 1112, stored within memory device(s) 1112, read into main memory 1114, and executed by processor(s) 1104 to perform one or more steps of the described methods.

In some embodiments of the present disclosure, instructions 1116 are stored on a computer-readable storage medium, or simply computer-readable medium. Such a computer-readable medium may be non-transitory, and may therefore be referred to as a non-transitory computer-readable medium. In some cases, the non-transitory computer-readable medium may be incorporated within computer system 1100. For example, the non-transitory computer-readable medium may include one of memory device(s) 1112, as shown in FIG. 11, with instructions 1116 being stored within memory device(s) 1112. In some cases, the non-transitory computer-readable medium may be separate from computer system 1100. In one example, the non-transitory computer-readable medium may be a removable media provided to input device(s) 1106, such as those described in reference to input device(s) 1106, as shown in FIG. 11, with instructions 1116 being provided to input device(s) 1106. In another example, the non-transitory computer-readable medium may include a component of a remote electronic device, such as a mobile phone, that may wirelessly transmit a data signal carrying instructions 1116 to computer system 1100 using communications subsystem 1110, as shown in FIG. 11, with instructions 1116 being provided to communications subsystem 1110.

Instructions 1116 may take any suitable form to be read and/or executed by computer system 1100. For example, instructions 1116 may be source code (written in a human-readable programming language such as Java, C, C++, C#, Python), object code, assembly language, machine code, microcode, executable code, and/or the like. In one example, instructions 1116 are provided to computer system 1100 in the form of source code, and a compiler is used to translate instructions 1116 from source code to machine code, which may then be read into main memory 1114 for execution by processor(s) 1104. As another example, instructions 1116 are provided to computer system 1100 in the form of an executable file with machine code that may immediately be read into main memory 1114 for execution by processor(s) 1104. In various examples, instructions 1116 may be provided to computer system 1100 in encrypted or unencrypted form, compressed or uncompressed form, as an installation package or an initialization for a broader software deployment, among other possibilities.

In one aspect of the present disclosure, a system (e.g., computer system 1100) is provided to perform methods in accordance with various embodiments of the present disclosure. For example, some embodiments may include a system comprising one or more processors (e.g., processor(s) 1104) that are communicatively coupled to a non-transitory computer-readable medium (e.g., memory device(s) 1112 or main memory 1114). The non-transitory computer-readable medium may have instructions (e.g., instructions 1116) stored therein that, when executed by the one or more processors, cause the one or more processors to perform the methods described in the various embodiments.

In another aspect of the present disclosure, a computer-program product that includes instructions (e.g., instructions 1116) is provided to perform methods in accordance with various embodiments of the present disclosure. The computer-program product may be tangibly embodied in a non-transitory computer-readable medium (e.g., memory device(s) 1112 or main memory 1114). The instructions may be configured to cause one or more processors (e.g., processor(s) 1104) to perform the methods described in the various embodiments.

In another aspect of the present disclosure, a non-transitory computer-readable medium (e.g., memory device(s) 1112 or main memory 1114) is provided. The non-transitory computer-readable medium may have instructions (e.g., instructions 1116) stored therein that, when executed by one or more processors (e.g., processor(s) 1104), cause the one or more processors to perform the methods described in the various embodiments.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. In addition, technology evolves and, thus, many of the elements are examples and do not limit the scope of the disclosure or claims.

Specific details are given in the description to provide a thorough understanding of exemplary configurations including implementations. However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

While various examples have been provided in the specification and drawings, it should be apparent to those skilled in the art that the scope of the disclosure is not limited to the specific embodiments described herein. For example, features of one or more embodiments may be combined with one or more features of other embodiments without departing from the scope of the disclosure. The specification and drawings are, accordingly, to be regarded in an illustrative rather than a restrictive sense. Thus, the scope of the disclosure should be determined not with reference to the above description, but with reference to the appended claims along with their full scope of equivalents.

What is claimed is:

1. A method for performing a measure-up process on an excavator, the measure-up process used to provide data that enables three-dimensional (3D) positioning of a tip of a bucket of the excavator, the method comprising:

curling the bucket of the excavator a first time between a fully out position and a fully in position multiple times, with a tilt compensating survey pole mounted to the bucket and an inertial measurement unit (IMU) coupled to a dog bone, the dog bone being part of a linkage between the bucket and a stick of the excavator;

moving the stick of the excavator in toward a cab of the excavator and out away from the cab of the excavator multiple times, with the tilt compensating survey pole coupled to the stick and the IMU coupled to the dog bone;

curling the bucket of the excavator a second time between the fully out position and the fully in position multiple times, with the tilt compensating survey pole coupled to the stick and the IMU coupled to the dog bone; and moving the bucket so that the tip of the bucket touches a point at multiple different bucket angles, with the tilt compensating survey pole coupled to the stick and the IMU coupled to the dog bone, wherein the point is at a known position;

wherein the data is generated using position measurements obtained using the tilt compensating survey pole, orientation and angular rate measurements obtained using the tilt compensating survey pole, IMU measurements obtained using the IMU, a distance from the tip of the bucket to a pivot point between the stick and the bucket, a lateral distance between a centerline of the stick and a phase center of a Global Navigation Satellite System (GNSS) antenna of the tilt compensating survey pole, and a width of the tip of the bucket, wherein the position measurements are obtained while performing the step of moving the bucket, and wherein the orientation and angular rate measurements and the IMU measurements are obtained while performing the steps of curling the bucket the first time, moving the stick of the excavator, curling the bucket the second time, and moving the bucket.

2. The method of claim 1 wherein the stick of the excavator is static while curling the bucket the first time.

3. The method of claim 1 wherein the tilt compensating survey pole includes sensors for performing the orientation and angular rate measurements and a global navigation satellite system (GNSS) receiver for performing the position measurements.

4. The method of claim 1 further comprising determining a position of the point using the tilt compensating survey pole.

5. An implement guidance system comprising the 3D positioning of the tip of the bucket configured to perform the method according to claim 1.

6. An excavator system having an implement guidance system, the implement guidance system comprising the 3D positioning of the tip of the bucket configured to perform the method according to claim 1.

* * * * *